US011780626B2

(12) United States Patent
Provoost et al.

(10) Patent No.: US 11,780,626 B2
(45) Date of Patent: Oct. 10, 2023

(54) BOX TEMPLATE FOLDING PROCESS AND MECHANISMS

(71) Applicant: Avercon BVBA, Eeklo (BE)

(72) Inventors: David Michel Provoost, Oudenaarde (BE); Herman Germain De Dycker, Wichelen (BE); Dimitri Daniël Raphaël Van Steenkiste, Wingene (BE); Stefaan Albert Marie-Louise Hamerlinck, Watervliet (BE)

(73) Assignee: Avercon BVBA, Eeklo (BE)

( * ) Notice: Subject to any disclaimer, the term of this patent is extended or adjusted under 35 U.S.C. 154(b) by 0 days.

(21) Appl. No.: 17/587,836

(22) Filed: Jan. 28, 2022

(65) Prior Publication Data

US 2022/0153462 A1 May 19, 2022

Related U.S. Application Data

(62) Division of application No. 16/375,588, filed on Apr. 4, 2019, now Pat. No. 11,305,903.

(Continued)

(30) Foreign Application Priority Data

Apr. 5, 2018 (BE) ..... 2018/05231
Oct. 10, 2018 (BE) ..... 2018/05698

(51) Int. Cl.
*B65B 5/02* (2006.01)
*B65B 43/10* (2006.01)
*B65B 5/06* (2006.01)

(52) U.S. Cl.
CPC ..... *B65B 43/10* (2013.01); *B65B 5/024* (2013.01); *B65B 5/06* (2013.01)

(58) Field of Classification Search
CPC ..... B65B 5/024; B65B 5/06; B65B 11/004; B65B 11/12; B65B 43/10; B31B 50/52; B31B 50/54; B31B 50/36
See application file for complete search history.

(56) References Cited

U.S. PATENT DOCUMENTS 1,809,853 A 6/1931 Knowlton
2,077,428 A 4/1937 Mabon
(Continued)

FOREIGN PATENT DOCUMENTS

CN 2164350 Y 5/1994
CN 1191833 A 9/1998
(Continued)

OTHER PUBLICATIONS

Final Office Action received for U.S. Appl. No. 13/147,787, dated Apr. 17, 2015.

(Continued)

*Primary Examiner* — Andrew M Tecco
(74) *Attorney, Agent, or Firm* — WORKMAN NYDEGGER

(57) ABSTRACT

Apparatus and methods of forming boxes from template blanks includes moving the blank forward on a drive line while one or more side panel fingers raise and lower various side panels of the blank in an alternating fashion. One or more holders maintain the side panels in position as the blank moves forward on the drive line. The raised and lowered side panels rigidify various panels from which they extend. The rigidified panels may be less susceptible to bending along false scores that extend transversely across the blank during folding and bending steps of the box forming process.

20 Claims, 14 Drawing Sheets

Related U.S. Application Data

(60) Provisional application No. 62/729,766, filed on Sep. 11, 2018.

(56) References Cited

U.S. PATENT DOCUMENTS 2,083,351 A 6/1937 Sidebotham
2,181,117 A 11/1939 Brenn
2,256,082 A 9/1941 Feurt
2,353,419 A 7/1944 Smithson
2,449,663 A 9/1948 Marcalus
2,609,736 A 9/1952 Montgomery
2,631,509 A 3/1953 Whytlaw
2,679,195 A 5/1954 Whytlaw
2,699,711 A 1/1955 Mobley
2,798,582 A 7/1957 Monroe et al.
2,853,177 A 9/1958 Engleson et al.
2,904,789 A * 9/1959 Radin ..... B31B 50/00 227/3
3,057,267 A * 10/1962 Johnson, Jr. ..... B65B 43/345 493/309
3,096,692 A 7/1963 Crathern et al.
3,105,419 A 10/1963 La Bombard
3,108,515 A 10/1963 Stohlquist
3,153,991 A 10/1964 Goodrich
3,218,940 A 11/1965 Pearson
3,285,145 A 11/1966 Lieberman
3,303,759 A 2/1967 Burke
3,308,723 A 3/1967 Bergh, Jr.
3,332,207 A * 7/1967 Midnight ..... B65B 5/024 53/223
3,406,611 A 10/1968 Benjamin et al.
3,418,893 A 12/1968 Stohlquist et al.
3,469,508 A 9/1969 Klapp
3,511,496 A 5/1970 Zoglmann
3,543,469 A * 12/1970 Ullman ..... B65B 43/10 53/376.5
3,555,776 A * 1/1971 Nigrelli et al. ..... B65B 5/026 53/209
3,566,755 A 3/1971 Smith et al.
3,611,884 A 10/1971 Hottendorf
3,618,479 A 11/1971 Shields
3,620,114 A 11/1971 Chudyk
3,628,408 A 12/1971 Rod
3,646,418 A 2/1972 Sterns et al.
3,743,154 A 7/1973 Brewitz
3,744,106 A 7/1973 Baum et al.
3,756,586 A 9/1973 Craft
3,763,750 A 10/1973 Reichert
3,776,109 A 12/1973 Clark et al.
3,803,798 A 4/1974 Clancy
3,804,514 A 4/1974 Jasinski
3,807,726 A 4/1974 Hope et al.
3,866,391 A * 2/1975 Puskarz ..... B65B 11/12 53/497
3,882,764 A 5/1975 Johnson
3,886,833 A 6/1975 Gunn et al.
3,891,203 A 6/1975 Schiff
3,912,389 A 10/1975 Miyamoto
3,913,464 A 10/1975 Flaum
3,949,654 A 4/1976 Stehlin
3,986,319 A 10/1976 Puskarz et al.
4,033,217 A 7/1977 Flaum et al.
4,044,658 A 8/1977 Mitchard
4,052,048 A 10/1977 Shirasaka
4,053,152 A 10/1977 Matsumoto
4,056,025 A 11/1977 Rubel
4,094,451 A 6/1978 Wescoat
4,121,506 A 10/1978 Van Grouw
4,123,966 A 11/1978 Buschor
4,162,870 A 7/1979 Storm
4,164,171 A 8/1979 Gorshe et al.
4,173,106 A 11/1979 Leasure et al.
4,184,770 A 1/1980 Pinior
4,191,467 A 3/1980 Schieck
4,221,373 A 9/1980 Mueller
4,222,557 A 9/1980 Wu
4,224,847 A 9/1980 Tokuno
4,252,233 A 2/1981 Joice
4,261,239 A 4/1981 Toboshi et al.
4,264,200 A 4/1981 Tickner et al.
4,295,841 A 10/1981 Ward, Jr.
4,320,960 A 3/1982 Ward et al.
4,342,562 A 8/1982 Froeidh et al.
4,351,461 A 9/1982 Carlsson
4,368,052 A 1/1983 Bitsky et al.
4,373,412 A 2/1983 Gerber et al.
4,375,970 A 3/1983 Murphy et al.
4,401,250 A 8/1983 Carlsson
4,449,349 A 5/1984 Roth
4,480,827 A 11/1984 Shultz et al.
4,487,596 A 12/1984 Livens et al.
4,563,169 A 1/1986 Virta et al.
4,578,054 A 3/1986 Herrin
D286,044 S 10/1986 Kando
4,638,696 A 1/1987 Urwyler
4,674,734 A 6/1987 Ibuchi
4,684,360 A 8/1987 Tokuno et al.
4,695,006 A 9/1987 Pool
4,714,946 A 12/1987 Bajgert et al.
4,743,131 A 5/1988 Atwell
4,749,295 A 6/1988 Bankier et al.
4,773,781 A 9/1988 Bankier
4,838,468 A 6/1989 Lesse
4,844,316 A 7/1989 Keeny
4,847,632 A 7/1989 Norris
4,878,521 A 11/1989 Fredrickson
4,887,412 A 12/1989 Takamura
4,923,188 A 5/1990 Neir
4,932,930 A 6/1990 Coalier et al.
4,979,932 A 12/1990 Burnside
4,994,008 A 2/1991 Haake et al.
5,005,816 A 4/1991 Stemmler et al.
5,024,641 A 6/1991 Boisseau
5,030,192 A 7/1991 Sager
5,039,242 A 8/1991 Johnson
5,046,716 A 9/1991 Lippold
5,058,872 A 10/1991 Gladow
5,072,641 A 12/1991 Urban et al.
5,074,836 A 12/1991 Fechner et al.
5,081,487 A 1/1992 Hoyer et al.
5,090,281 A 2/1992 Paulson et al.
5,094,660 A 3/1992 Okuzawa
5,106,359 A 4/1992 Lott
5,111,252 A 5/1992 Hamada et al.
5,116,034 A 5/1992 Trask et al.
5,118,093 A 6/1992 Makiura et al.
5,120,279 A 6/1992 Rabe
5,120,297 A 6/1992 Adami
5,123,890 A 6/1992 Green, Jr.
5,123,894 A 6/1992 Bergeman et al.
5,137,172 A 8/1992 Wagner et al.
5,137,174 A 8/1992 Bell
5,148,654 A 9/1992 Kisters
5,154,041 A * 10/1992 Schneider ..... B65B 7/26 53/376.5
5,157,903 A 10/1992 Nakashima et al.
5,197,366 A 3/1993 Paulson et al.
5,240,243 A 8/1993 Gompertz et al.
5,241,353 A 8/1993 Maeshima et al.
5,259,255 A 11/1993 Urban et al.
5,263,785 A 11/1993 Negoro et al.
D344,751 S 3/1994 Keong
5,305,993 A 4/1994 Staeb
5,321,464 A 6/1994 Jessen et al.
5,335,777 A 8/1994 Murphy et al.
5,358,345 A 10/1994 Damitio
5,369,939 A 12/1994 Moen et al.
5,375,390 A 12/1994 Frigo et al.
5,397,423 A 3/1995 Bantz et al.
5,411,252 A 5/1995 Lowell
5,531,661 A 7/1996 Moncrief
5,584,633 A 12/1996 Scharer
5,586,758 A 12/1996 Kimura et al.

(56) References Cited

U.S. PATENT DOCUMENTS 5,624,369 A 4/1997 Bidlack et al.
5,667,468 A 9/1997 Bandura
5,671,593 A 9/1997 Ginestra et al.
5,716,313 A 2/1998 Sigrist et al.
5,727,725 A 3/1998 Paskvich
5,767,975 A 6/1998 Ahlen
5,836,498 A 11/1998 Turek
5,865,918 A 2/1999 Franklin et al.
5,887,867 A 3/1999 Takahashi et al.
5,902,223 A 5/1999 Simmons
5,927,702 A 7/1999 Ishii et al.
5,941,451 A 8/1999 Dexter
5,964,686 A 10/1999 Bidlack et al.
6,000,525 A 12/1999 Frulio
6,071,223 A 6/2000 Reider et al.
6,076,764 A 6/2000 Robinson
6,107,579 A 8/2000 Kinnemann
6,113,525 A * 9/2000 Waechter ..... B65B 19/228 493/911
6,135,438 A 10/2000 Newman et al.
6,164,045 A 12/2000 Focke et al.
6,179,765 B1 1/2001 Toth
6,189,933 B1 2/2001 Felderman
6,244,436 B1 6/2001 Boriani et al.
6,245,004 B1 6/2001 Waters
6,321,650 B1 11/2001 Ogawa et al.
6,397,557 B1 6/2002 Bassissi et al.
6,428,000 B1 8/2002 Hara
6,471,154 B2 10/2002 Toth
6,553,207 B2 4/2003 Tsusaka et al.
6,568,865 B1 5/2003 Fujioka et al.
6,673,001 B2 1/2004 Toth
6,690,476 B1 2/2004 Hren
6,709,177 B1 3/2004 Sugimura
6,830,328 B2 12/2004 Cuyler, Jr.
6,837,135 B2 1/2005 Michalski
6,840,898 B2 1/2005 Pettersson
6,910,997 B1 6/2005 Yampolsky et al.
6,968,859 B1 11/2005 Nagano et al.
7,060,016 B2 6/2006 Cipolli
7,100,811 B2 9/2006 Pettersson et al.
7,115,086 B1 10/2006 Campbell, Jr.
7,121,543 B2 10/2006 Fujioka
7,201,089 B2 4/2007 Richter
7,237,969 B2 7/2007 Bartman
7,537,557 B2 5/2009 Holler
7,637,857 B2 12/2009 Coullery et al.
7,641,190 B2 1/2010 Hara et al.
7,647,752 B2 1/2010 Magnell
7,648,451 B2 1/2010 Calugi
7,648,596 B2 1/2010 Sharpe et al.
7,690,099 B2 4/2010 Bapst et al.
7,735,299 B2 6/2010 Cash, III
7,739,856 B2 6/2010 Cash, III
7,997,578 B2 8/2011 Saito et al.
8,052,138 B2 11/2011 Wang
8,141,868 B1 3/2012 Wang et al.
8,646,248 B2 2/2014 Iwasa et al.
D703,246 S 4/2014 Pettersson et al.
8,999,108 B2 4/2015 Nagao et al.
9,027,315 B2 5/2015 Tsutsumi et al.
9,069,151 B2 6/2015 Conner
9,120,284 B2 9/2015 Capoia
9,199,794 B2 12/2015 Nadachi et al.
9,216,867 B2 12/2015 Aoyama
9,329,565 B2 5/2016 Osaki
9,352,526 B2 5/2016 Pettersson
9,434,496 B2 * 9/2016 Sytema ..... B31B 50/54
9,771,231 B2 9/2017 Pettersson
9,924,502 B2 3/2018 Choi
9,969,142 B2 5/2018 Pettersson et al.
10,093,438 B2 10/2018 Pettersson
10,155,352 B2 * 12/2018 Sytema ..... B31B 50/262
10,286,621 B2 5/2019 Toro
10,583,943 B2 * 3/2020 Feijen ..... B65B 5/024
10,836,516 B2 11/2020 Pettersson
10,836,517 B2 * 11/2020 Ponti ..... B65D 5/443
2002/0017754 A1 2/2002 Kang
2002/0066683 A1 6/2002 Sanders
2002/0091050 A1 7/2002 Bacciottini et al.
2002/0108476 A1 8/2002 Guidetti
2002/0115548 A1 8/2002 Lin et al.
2002/0125712 A1 9/2002 Felderman
2002/0139890 A1 10/2002 Toth
2003/0102244 A1 6/2003 Sanders
2003/0104911 A1 6/2003 Toth et al.
2003/0217628 A1 11/2003 Michalski
2004/0060264 A1 4/2004 Miller
2004/0082453 A1 4/2004 Pettersson
2004/0092374 A1 5/2004 Cheng
2004/0144555 A1 7/2004 Buekers et al.
2004/0173068 A1 9/2004 Nokihisa
2004/0198577 A1 10/2004 Blumle
2004/0214703 A1 10/2004 Berens et al.
2004/0261365 A1 12/2004 White
2005/0079965 A1 4/2005 Moshier et al.
2005/0103923 A1 5/2005 Pettersson et al.
2005/0215409 A1 9/2005 Abramson et al.
2005/0280202 A1 12/2005 Vila et al.
2006/0082044 A1 4/2006 Aida
2006/0178248 A1 8/2006 Coullery et al.
2006/0180438 A1 8/2006 Mosli et al.
2006/0180991 A1 8/2006 Nakahata et al.
2006/0181008 A1 8/2006 Van et al.
2007/0079575 A1 4/2007 Monti
2007/0227927 A1 10/2007 Coltri-Johnson
2007/0228119 A1 10/2007 Barner
2007/0287623 A1 12/2007 Carlson et al.
2007/0289253 A1 12/2007 Miller
2008/0020916 A1 1/2008 Magnell
2008/0037273 A1 2/2008 Muehlemann et al.
2008/0066632 A1 3/2008 Raueiser
2008/0115641 A1 5/2008 Freyburger et al.
2008/0148917 A1 6/2008 Pettersson
2008/0300120 A1 12/2008 Sato
2009/0062098 A1 3/2009 Inoue et al.
2009/0178528 A1 7/2009 Adami
2009/0199527 A1 8/2009 Wehr et al.
2010/0011924 A1 1/2010 Bernreuter
2010/0012628 A1 1/2010 Koshy et al.
2010/0041534 A1 2/2010 Harding et al.
2010/0111584 A1 5/2010 Shiohara et al.
2010/0206582 A1 8/2010 Meyyappan et al.
2010/0210439 A1 8/2010 Goto
2011/0026999 A1 2/2011 Kohira
2011/0053746 A1 3/2011 Desertot et al.
2011/0092351 A1 4/2011 Hatano et al.
2011/0099782 A1 5/2011 Schonberger et al.
2011/0110749 A1 5/2011 Carter et al.
2011/0171002 A1 7/2011 Pettersson
2011/0229191 A1 9/2011 Nomi
2011/0230325 A1 9/2011 Harding et al.
2011/0240707 A1 10/2011 Beguin et al.
2011/0269995 A1 11/2011 Olbert et al.
2011/0283855 A1 11/2011 Kwarta et al.
2011/0319242 A1 12/2011 Pettersson
2012/0021884 A1 1/2012 Musha
2012/0037680 A1 2/2012 Ito
2012/0106963 A1 5/2012 Huang et al.
2012/0122640 A1 5/2012 Pazdernik et al.
2012/0129670 A1 5/2012 Pettersson et al.
2012/0139670 A1 6/2012 Yamagata et al.
2012/0142512 A1 6/2012 Keller
2012/0242512 A1 9/2012 Horstemeyer
2012/0275838 A1 11/2012 Imazu et al.
2012/0319920 A1 12/2012 Athley et al.
2012/0328253 A1 12/2012 Hurley et al.
2013/0000252 A1 1/2013 Pettersson et al.
2013/0045847 A1 2/2013 Capoia
2013/0104718 A1 5/2013 Tai
2013/0108227 A1 5/2013 Conner
2013/0108408 A1 5/2013 Saison et al.
2013/0130877 A1 5/2013 Su
2013/0146355 A1 6/2013 Strasser et al.

(56) References Cited

U.S. PATENT DOCUMENTS

| | | | |
|---|---|---|---|
| 2013/0210597 | A1 | 8/2013 | Pettersson |
| 2013/0294735 | A1 | 11/2013 | Burris et al. |
| 2013/0333538 | A1 | 12/2013 | Long et al. |
| 2014/0078635 | A1 | 3/2014 | Conner et al. |
| 2014/0091511 | A1 | 4/2014 | Martin |
| 2014/0100100 | A1 | 4/2014 | Izumichi |
| 2014/0101929 | A1 | 4/2014 | Kim et al. |
| 2014/0121093 | A1 | 5/2014 | Braschoss et al. |
| 2014/0140671 | A1 | 5/2014 | Islam |
| 2014/0141956 | A1 | 5/2014 | Suzuki et al. |
| 2014/0171283 | A1 | 6/2014 | Furuhashi et al. |
| 2014/0179504 | A1 | 6/2014 | Nakada et al. |
| 2014/0206518 | A1 | 7/2014 | Hidaka et al. |
| 2014/0315701 | A1 | 10/2014 | Pettersson |
| 2014/0316336 | A1 | 10/2014 | Hawasheen |
| 2014/0318336 | A1 | 10/2014 | De Marco et al. |
| 2014/0336026 | A1 | 11/2014 | Pettersson |
| 2014/0357463 | A1 | 12/2014 | Kojima |
| 2015/0018189 | A1 | 1/2015 | Pettersson et al. |
| 2015/0019387 | A1 | 1/2015 | Pettersson et al. |
| 2015/0045197 | A1 | 2/2015 | Sugiyama et al. |
| 2015/0053349 | A1 | 2/2015 | Mori et al. |
| 2015/0055926 | A1 | 2/2015 | Strasser et al. |
| 2015/0103923 | A1 | 4/2015 | Ramasubramonian et al. |
| 2015/0148210 | A1 | 5/2015 | Sibthorpe |
| 2015/0155697 | A1 | 6/2015 | Loveless et al. |
| 2015/0224731 | A1 | 8/2015 | Ponti |
| 2015/0273897 | A1 | 10/2015 | Kato et al. |
| 2015/0355429 | A1 | 12/2015 | Villegas et al. |
| 2015/0360433 | A1* | 12/2015 | Feijen ..... B31B 50/74 493/162 |
| 2015/0360801 | A1 | 12/2015 | Sytema |
| 2016/0001441 | A1 | 1/2016 | Osterhout et al. |
| 2016/0049782 | A1 | 2/2016 | Strasser et al. |
| 2016/0122044 | A1 | 5/2016 | Evers et al. |
| 2016/0184142 | A1 | 6/2016 | Vanvalkenburgh et al. |
| 2016/0185065 | A1* | 6/2016 | Sytema ..... B31B 50/52 493/183 |
| 2016/0185475 | A1 | 6/2016 | Pettersson |
| 2016/0229145 | A1 | 8/2016 | Pettersson et al. |
| 2016/0241468 | A1 | 8/2016 | Sabella et al. |
| 2016/0340067 | A1 | 11/2016 | Winkler et al. |
| 2017/0057190 | A1 | 3/2017 | Toro |
| 2017/0190134 | A1* | 7/2017 | van der Dong ..... B65D 5/4266 |
| 2017/0355166 | A1 | 12/2017 | Jonker |
| 2017/0361560 | A1 | 12/2017 | Osterhout |
| 2018/0050833 | A1 | 2/2018 | Sytema et al. |
| 2018/0178476 | A1 | 6/2018 | Pettersson et al. |
| 2018/0201465 | A1 | 7/2018 | Osterhout |
| 2018/0265228 | A1 | 9/2018 | Hagestedt et al. |
| 2019/0002137 | A1 | 1/2019 | Pettersson |
| 2019/0184670 | A1 | 6/2019 | Davies et al. |
| 2019/0308383 | A1 | 10/2019 | Provoost et al. |
| 2019/0308761 | A1 | 10/2019 | Provoost et al. |
| 2019/0329513 | A1 | 10/2019 | Pettersson |
| 2019/0389611 | A1 | 12/2019 | Pettersson |
| 2020/0031506 | A1* | 1/2020 | Ponti ..... B65B 5/024 |
| 2020/0101686 | A1 | 4/2020 | Fredander et al. |
| 2020/0407087 | A1 | 12/2020 | Pettersson |
| 2021/0001583 | A1 | 1/2021 | Osterhout |
| 2021/0039347 | A1 | 2/2021 | Pettersson et al. |
| 2021/0261281 | A1 | 8/2021 | Engleman et al. |
| 2021/0370633 | A1 | 12/2021 | Provoost et al. |
| 2021/0371229 | A1 | 12/2021 | Osterhout |
| 2023/0142034 | A1 | 5/2023 | Engleman et al. |

FOREIGN PATENT DOCUMENTS

| | | | |
|---|---|---|---|
| CN | 1275515 | A | 12/2000 |
| CN | 1366487 | A | 8/2002 |
| CN | 1449966 | A | 10/2003 |
| CN | 1494502 | A | 5/2004 |
| CN | 1876361 | A | 12/2006 |
| CN | 2925862 | Y | 7/2007 |
| CN | 201941185 | U | 8/2011 |
| CN | 201990294 | U | 9/2011 |
| CN | 102264532 | A | 11/2011 |
| CN | 102371705 | A | 3/2012 |
| CN | 102574654 | A | 7/2012 |
| CN | 202412794 | U | 9/2012 |
| CN | 102753442 | A | 10/2012 |
| CN | 102756943 | A | 10/2012 |
| CN | 102791581 | A | 11/2012 |
| CN | 103534069 | A | 1/2014 |
| CN | 104044166 | A | 9/2014 |
| CN | 104169073 | A | 11/2014 |
| CN | 104185538 | A | 12/2014 |
| CN | 102941592 | | 4/2015 |
| CN | 104812560 | A | 7/2015 |
| CN | 104890208 | A | 9/2015 |
| CN | 104985868 | A | 10/2015 |
| CN | 204773785 | U | 11/2015 |
| CN | 106079570 | A | 11/2016 |
| CN | 107206216 | A | 9/2017 |
| CN | 107614253 | A | 1/2018 |
| DE | 1082227 | | 5/1960 |
| DE | 1212854 | B | 3/1966 |
| DE | 2700004 | A1 | 7/1978 |
| DE | 2819000 | A1 | 11/1978 |
| DE | 3343523 | A1 | 6/1985 |
| DE | 3825506 | A1 | 2/1990 |
| DE | 19541061 | C1 | 11/1996 |
| DE | 10355544 | A1 | 6/2005 |
| DE | 102005063193 | A1 | 7/2007 |
| DE | 102008035278 | A1 | 2/2010 |
| EP | 0030366 | A1 | 6/1981 |
| EP | 0234228 | A2 | 9/1987 |
| EP | 0359005 | A1 | 3/1990 |
| EP | 0650827 | A2 | 5/1995 |
| EP | 0889779 | A2 | 1/1999 |
| EP | 0903219 | A2 | 3/1999 |
| EP | 1065162 | A2 | 1/2001 |
| EP | 1223107 | A1 | 7/2002 |
| EP | 1373112 | A1 | 1/2004 |
| EP | 1428759 | A2 | 6/2004 |
| EP | 1997736 | A2 | 12/2008 |
| EP | 1497049 | B1 | 3/2010 |
| EP | 2228206 | A1 | 9/2010 |
| EP | 2377764 | A1 | 10/2011 |
| EP | 3231594 | A1 | 10/2017 |
| FR | 0428967 | A | 9/1911 |
| FR | 1020458 | A | 2/1953 |
| FR | 1592372 | A | 5/1970 |
| FR | 2280484 | A1 | 2/1976 |
| FR | 2411700 | A1 | 7/1979 |
| FR | 2626642 | A1 | 8/1989 |
| FR | 2721301 | A1 | 12/1995 |
| FR | 2770445 | A1 | 5/1999 |
| FR | 2808722 | A1 | 11/2001 |
| FR | 2814393 | A1 | 3/2002 |
| FR | 2976561 | A1 | 12/2012 |
| GB | 0166622 | | 7/1921 |
| GB | 0983946 | A | 2/1965 |
| GB | 1362060 | A | 7/1974 |
| GB | 1546789 | A | 5/1979 |
| JP | 49-099239 | A | 9/1974 |
| JP | 50-078616 | A | 6/1975 |
| JP | 51-006358 | Y1 | 2/1976 |
| JP | 51-027619 | A | 3/1976 |
| JP | 51-098591 | A | 8/1976 |
| JP | 55-057984 | A | 4/1980 |
| JP | 56-089937 | A | 7/1981 |
| JP | 59-176836 | A | 10/1984 |
| JP | 59-198243 | A | 11/1984 |
| JP | 61-118720 | A | 6/1986 |
| JP | 62-172032 | | 10/1987 |
| JP | 01-133164 | A | 5/1989 |
| JP | 03-070927 | A | 3/1991 |
| JP | 3089399 | | 9/1991 |
| JP | 06-123606 | A | 5/1994 |
| JP | 06-142585 | A | 5/1994 |
| JP | 07-156305 | A | 6/1995 |
| JP | 08-132388 | A | 5/1996 |

(56) References Cited

FOREIGN PATENT DOCUMENTS

| | | | |
|---|---|---|---|
| JP | 08-238690 | A | 9/1996 |
| JP | 08-333036 | A | 12/1996 |
| JP | 09-506847 | A | 7/1997 |
| JP | 09-510548 | A | 10/1997 |
| JP | 11-320492 | A | 11/1999 |
| JP | 2000-323324 | A | 11/2000 |
| JP | 2003-079446 | A | 3/2003 |
| JP | 2003-112849 | A | 4/2003 |
| JP | 2003-165167 | A | 6/2003 |
| JP | 2003-194516 | A | 7/2003 |
| JP | 2004-330351 | A | 11/2004 |
| JP | 2005-067019 | A | 3/2005 |
| JP | 2005-219798 | A | 8/2005 |
| JP | 2006-289914 | A | 10/2006 |
| JP | 2007-331810 | A | 12/2007 |
| JP | 2008-254789 | A | 10/2008 |
| JP | 2009-023074 | | 2/2009 |
| JP | 2009-132049 | A | 6/2009 |
| JP | 2010-012628 | A | 1/2010 |
| JP | 2011-053284 | A | 3/2011 |
| JP | 2011-520674 | A | 7/2011 |
| JP | 2011-230385 | A | 11/2011 |
| JP | 2015-502273 | A | 1/2015 |
| JP | 2016-074133 | A | 5/2016 |
| JP | 2020-504038 | A | 2/2020 |
| RU | 2015030 | C1 | 6/1994 |
| RU | 2004136918 | A | 5/2006 |
| RU | 2334668 | C2 | 9/2008 |
| RU | 2345893 | C2 | 2/2009 |
| RU | 2398674 | C1 | 9/2010 |
| RU | 2014123534 | A | 12/2015 |
| RU | 2014123562 | A | 12/2015 |
| SE | 0450829 | B | 8/1987 |
| SE | 450829 | B | 8/1987 |
| SE | 515630 | C2 | 9/2001 |
| SU | 40025 | A1 | 12/1934 |
| SU | 213570 | A1 | 3/1968 |
| SU | 992220 | A1 | 1/1983 |
| SU | 1054863 | A1 | 11/1983 |
| SU | 1121156 | A1 | 10/1984 |
| SU | 1676825 | A1 | 9/1991 |
| SU | 1718783 | A1 | 3/1992 |
| SU | 1756211 | A1 | 8/1992 |
| TW | 394741 | B | 6/2000 |
| WO | 95/24298 | A1 | 9/1995 |
| WO | 96/10518 | A1 | 4/1996 |
| WO | 96/14773 | A1 | 5/1996 |
| WO | 97/31773 | A2 | 9/1997 |
| WO | 99/17923 | A1 | 4/1999 |
| WO | 00/21713 | A1 | 4/2000 |
| WO | 01/04017 | A1 | 1/2001 |
| WO | 01/85408 | A2 | 11/2001 |
| WO | 02/79062 | A1 | 10/2002 |
| WO | 03/89163 | A2 | 10/2003 |
| WO | 03/97340 | | 11/2003 |
| WO | 2009/093936 | A1 | 7/2009 |
| WO | 2010/091043 | A1 | 8/2010 |
| WO | 2011/007237 | A1 | 1/2011 |
| WO | 2011/100078 | A2 | 8/2011 |
| WO | 2011/135433 | A1 | 11/2011 |
| WO | 2012/003167 | A1 | 1/2012 |
| WO | 2013/071073 | A1 | 5/2013 |
| WO | 2013/071080 | A1 | 5/2013 |
| WO | 2013/106180 | A1 | 7/2013 |
| WO | 2013/114057 | A2 | 8/2013 |
| WO | 2014/048934 | A1 | 4/2014 |
| WO | 2014/117816 | | 8/2014 |
| WO | 2014/117817 | A1 | 8/2014 |
| WO | 2014/188010 | A2 | 11/2014 |
| WO | 2015/173745 | A1 | 11/2015 |
| WO | 2016/176271 | A1 | 11/2016 |
| WO | 2017/203399 | A1 | 11/2017 |
| WO | 2017/203401 | A1 | 11/2017 |
| WO | 2017/218296 | A1 | 12/2017 |
| WO | 2017/218297 | A1 | 12/2017 |
| WO | 2019/246344 | A1 | 12/2019 |

OTHER PUBLICATIONS

Final Office Action received for U.S. Appl. No. 13/147,787, dated Feb. 16, 2016.

Final Office Action received for U.S. Appl. No. 13/147,787, dated Mar. 7, 2017.

Final Office Action received for U.S. Appl. No. 14/357,183, dated Nov. 12, 2015.

Final Office Action received for U.S. Appl. No. 14/357,190, dated Aug. 1, 2017.

Final Office Action received for U.S. Appl. No. 14/370,729, dated Jul. 12, 2017.

Final Office Action received for U.S. Patent Application No. 15/872,770, dated Sep. 16, 2020, 17 pages.

Final Office Action received for U.S. Appl. No. 16/619,818, dated Feb. 3, 2022, 10 pages.

International Search Report and Wirtten Opinion for application No. PCT/US2012/070719 dated Feb. 25, 2013.

International Search Report and Written Opinion for application No. PCT/US2012/070719 dated Feb. 25, 2013.

International Search Report and Written Opinion for application No. PCT/US2017/036603 dated Oct. 18, 2017.

International Search Report and Written Opinion for application No. PCT/US2017/036606 dated Oct. 24, 2017.

International Search Report and Written Opinion for corresponding PCT Application No. PCT/IB2015/054179, dated Aug. 28, 2015, 13 pages.

International Search Report and Written Opinion for PCT/US18/14275 dated Apr. 4, 2018.

International Search Report and Written Opinion for PCT/US19/62696 dated Feb. 4, 2020.

International Search Report and Written Opinion for PCT/US2015/67375 dated Mar. 11, 2016.

International Search Report and Written Opinion for PCT/US2019/049102 dated Dec. 2, 2019.

International Search Report and Written Opinion from International Application No. PCT/US2010/022983 dated Apr. 13, 2010.

International Search Report and Written Opinion issued in PCT/US2018/032311 dated Sep. 20, 2018.

International Search Report and Written Opinion issued in PCT/US2019/038142 dated Aug. 19, 2019.

International Search Report and Written Opinion PCT/IB2019/052793 dated Nov. 11, 2019.

International Search Report and Written Opinion PCT/IB2019/052794 dated Jun. 19, 2019.

International Search Report and Written Opinion received for PCT Patent Application No. PCT/US2018/020928, dated Jun. 7, 2018, 9 pages.

International Search Report and Written Opinion received for PCT Patent Application No. PCT/US2019/049535, dated Jun. 9, 2020, 14 pages.

International Search Report and Written Opinion received for PCT Patent Application No. PCT/US2020/012519, dated Jun. 26, 2020, 19 pages.

International Search Report and Written Opinion, PCT/US2012/064403, US Search Authority, Completed Mar. 26, 2013, dated Apr. 8, 2013.

International Search Report and Written Opinion, PCT/US2012/064414, US Search Authority, Completed Jan. 4, 2013, dated Jan. 25, 2013.

International Search Report for PCT/US2011/042096 dated Oct. 28, 2011.

Non-Final Office Action received for U.S. Appl. No. 15/872,770, dated Nov. 10, 2020, 24 pages.

Non-Final Office Action received for U.S. Appl. No. 16/310,406, dated Aug. 19, 2020, 22 pages.

Non-Final Office Action received for U.S. Appl. No. 16/375,579, dated Feb. 18, 2021, 12 pages.

(56) References Cited

OTHER PUBLICATIONS

Non-Final Office Action received for U.S. Appl. No. 16/375,588, dated Jul. 2, 2021, 15 pages.
Non-Final Office Action received for U.S. Appl. No. 16/619,818, dated Aug. 31, 2021, 13 pages.
Notice of Allowance received for U.S. Appl. No. 15/901,089, dated Jan. 31, 2022, 9 pages.
Office Action received for U.S. Appl. No. 13/147,787, dated Aug. 27, 2014.
Office Action received for U.S. Appl. No. 13/147,787, dated Oct. 28, 2016.
Office Action received for U.S. Appl. No. 13/147,787, dated Sep. 30, 2015.
Office Action received for U.S. Appl. No. 13/805,602, dated Dec. 2, 2015.
Office Action received for U.S. Appl. No. 14/357,183, dated Jul. 16, 2015.
Office Action received for U.S. Appl. No. 14/357,190, dated Feb. 17, 2017.
Office Action received for U.S. Appl. No. 14/370,729, dated Dec. 19, 2017.
Office Action received for U.S. Appl. No. 14/370,729, dated Jan. 26, 2017.
Office Action received for U.S. Appl. No. 14/970,224, dated May 30, 2018.
Office Action received for U.S. Appl. No. 15/616,688, dated Mar. 19, 2020.
Office Action received for U.S. Appl. No. 15/872,770, dated Mar. 27, 2020.
Office Action received for U.S. Appl. No. 15/901,089, dated Apr. 13, 2020.
Office Action received for U.S. Appl. No. 16/109,261, dated Apr. 28, 2020.
Office Action received for U.S. Appl. No. 29/419,922, dated Aug. 6, 2013.
Definition of Against, per Merriam-Webster, retrieved on Oct. 4, 2022 from URL: https://www.merriam-webster.com/dictionary/against (Year: 2022).
Definition of Cam, per "Oxford Languages", retreived on Sep. 29, 2022 from (abridged) URL: https://tinyurl.com/17082294URL1 (Year: 2022).
Final Office Action received for U.S. Appl. No. 17/023,088, dated Nov. 8, 2022, 20 pages.
Final Office Action received for U.S. Appl. No. 17/082,294, dated Jan. 20, 2023, 13 pages.
Non-Final Office Action received for U.S. Appl. No. 17/023,088, dated May 10, 2022, 11 pages.
Non-Final Office Action received for U.S. Appl. No. 17/082,294, dated Oct. 12, 2022, 12 pages.
Non-Final Office Action received for U.S. Appl. No. 17/252,722, dated Sep. 9, 2022, 13 pages.

* cited by examiner

BOX TEMPLATE FOLDING PROCESS AND MECHANISMS

CROSS-REFERENCE TO RELATED APPLICATIONS

This application is a divisional of U.S. patent application Ser. No. 16/375,588, filed Apr. 4, 2019, and entitled "Box Template Folding Process and Mechanisms," which claims priority to and the benefit of: U.S. Patent Application Ser. No. 62/729,766, filed Sep. 11, 2018, and entitled "Box Template Folding Process and Mechanisms"; Belgian Patent Application No. 2018/05231, filed Apr. 5, 2018, and entitled "Folding Sequence"; and Belgian Patent Application No. 2018/05698, filed Oct. 10, 2018, and entitled "Box Template Folding Process and Mechanisms". The entirety of each of the foregoing applications is incorporated herein by this reference.

BACKGROUND

Technical Field

The present disclosure relates to packaging machines. More specifically, the present disclosure relates to methods and apparatus for forming customized packaging boxes from sheet material.

The Relevant Technology

Sales of goods and services via the internet have risen sharply in recent years and this trend is expected to continue. The vast majority of online orders are shipped to the customer, requiring most products purchased online to be packaged for shipping. With the wide range of products being ordered, packaging can present a number of challenges for manufacturers and distributors. For example, while products of all shapes and sizes need to be packaged and sent to customers, manufacturers and/or distributors may only have a limited variety of box sizes to accommodate such products.

As a result, products are often placed into boxes that are too big. Using boxes that are too big uses additional packaging materials, which is wasteful and costly. Also, packaging boxes that are too big for the product being shipped results in wasted space inside the box and around the product. This extra space can cause the product to shift, bounce, or otherwise move around in the box during shipping, which leads to the product being damaged during transport. In many case, filler material is placed around the product inside the box to prevent the product from being jostled too much. However, the extra filler material costs money and time.

There are packaging machines that are capable of customizing packaging boxes to specific product sizes in order to limit or eliminate some of the challenges mentioned above. In such machines, boxes are formed from sheet material that is fed into the machine, which cuts the sheet material into a box template (or "blank"). The blank is then folded into a box.

Prior to being formed into box templates, the sheet material can be folded back and forth on top of itself in alternating segments in a stack. As such, the sheet material includes score or fold lines extending across the material between segments. Because of these score or fold lines, using fanfold material (e.g., sheet material that has been folded back and forth on itself) to form blanks can be problematic. For example, the blank formed from fanfold material often does extends across multiple segments of the fanfold material. Thus, blanks formed from fanfold material often have score or fold lines extending across one or more panels, tabs, or other sections of the blank. These fanfold score or fold lines extending across the blank are referred to as "false scores" because they likely do not fall directly on the blank where the blank is supposed to be folded. That is, packaging machines typically bend the blanks at boundaries between the panels and tabs to form boxes and false scores do not necessarily align with those boundaries. As such, false scores create weaknesses in the blank material that may cause certain panels or tabs of the blank to collapse, bend, rip, or otherwise fail during bending or other box folding processes within a packaging machine.

The difficulties presented by false scores extending across blanks are exacerbated when the packaging machine is tasked with forming a variety of customizable box sizes, as discussed above, from generic fanfold material. In such situations, false scores extending across blanks can occur at any point along the length of the blank, depending on the size and configuration of the blank, which may change based on the size of the product being packaged. Essentially, the position of false scores on blanks can vary from one blank to the next. This variability makes it difficult for manufacturers and/or distributors to adapt packaging machines to overcome the difficulties false scores present during customizable package forming processes.

Accordingly, there are a number of problems in the art that need to be addressed. The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

The present disclosure relates to packaging machines. More specifically, the present disclosure relates to methods and apparatus for forming customized packaging boxes from generic fanfold material. For example, in an embodiment of the present disclosure, a method of forming a box from a blank includes providing a blank on a drive line. The blank can include a plurality of panels, including a leading panel, and intermediate panel, a bottom panel, a trailing panel, and a glue tab extending form the trailing panel. Each panel has one or more side flaps extending therefrom. In such an embodiment, the method further includes moving the blank forward on the drive line and folding the side flaps up and down in an alternating fashion.

In one embodiment of the present disclosure, a method for forming a box includes providing a blank on a drive line and moving the blank forward thereon. While the blank is moving forward on the drive line, various side flaps of the blank are moved up and down in alternating fashion to rigidify panels from which the side flaps extend. Also, a holder maintains the side flaps that have been folded up in position and holds a bottom panel of the blank down while adjacent panels of the blank are folded up and over to form back, front, and top surfaces of the box. In such an embodiment, the bottom leading corner of the holder is chamfered so that the leading panels of the blank can be partially folded up before the leading panel completely passes a leading edge of the holder.

In one embodiment of the present disclosure, a method for forming a box includes providing a blank on a drive line and moving the blank forward thereon. While the blank is moving forward on the drive line, various side flaps of the blank are moved up and down in alternating fashion to rigidify panels from which the side flaps extend. In such an embodiment, a holder maintains the side flaps that have been folded up in position and holds a bottom panel of the blank down while adjacent panels of the blank are folded up and over to form back, front, and top surfaces of the box. Also, a spatula arm folds the glue tab downward and the leading edge of the spatula makes contact with a boundary of the leading two panels of the blank. In this way, the leading two panels are folded at the boundary to form the top and front surfaces of the box.

In one embodiment of the present disclosure, a method for forming a box includes providing a blank on a drive line and moving the blank forward thereon. While the blank is moving forward on the drive line, various side flaps of the blank are moved up and down in alternating fashion to rigidify panels from which the side flaps extend. Also, a holder maintains the side flaps that have been folded up in position and holds a bottom panel of the blank down while adjacent panels of the blank are folded up and over to form back, front, and top surfaces of the box.

In one embodiment of the present disclosure, a method of forming a box from a blank includes providing a blank on a drive line. The blank can include a plurality of panels, including a leading panel, and intermediate panel, a bottom panel, a trailing panel, and a glue tab extending form the trailing panel. Each panel has one or more side flaps extending therefrom. In such an embodiment, the method includes moving the blank forward on the drive line and folding the side flaps up and down in an alternating fashion. A holder maintains the folded side flaps in position while the blank moves forward on the drive line. As the blank continues to move forward, the two leading panels and the two trailing panels are folded up and over to form the top, front, rear, and glue tab surfaces of the box, respectively. In addition, in such an embodiment, one or more trailing squaring arms and one or more leading squaring arms maintain the bottom trailing corner and the top leading corner of the box at a fixed angle.

In one embodiment of the present disclosure, a box forming machine includes a drive line. The drive line has a longitudinal direction and a drive mechanism configured to transport a blank forward on the drive line. The box forming machine also includes one or more fingers and one or more holders. The fingers are configured to lift and push down side flaps of the blank in an alternating fashion as the blank moves forward on the drive line. The one or more holders are configured to hold the side flaps of the blank in position as the blank moves forward on the drive line.

In one embodiment, a method for folding a box from a blank is performed on a feed line with an advancing direction of movement. The method includes supplying the blank on the feed line such that side panels of the blank extend transversely of the feed line. One or more goods are positioned on a middle panel of the blank. The blank is advanced with the one or more goods along the feed line. The side panels which lie diagonally of the middle panel are folded upward. A rear panel is folded upward and held in place as a rear wall of the box. Front panels are folded upward by moving an arm upward during forward movement of the blank. Folding the front panels upward includes folding the front panels from a first position under the feed line to a second position above the box, such that the box advances under the upward moved arm in order to form a front wall and an upper wall of the box with the front panels.

In one embodiment, a device is provided for folding a box from a blank while the blank advances in a direction of movement along a feed line. The device includes a supply section for supplying the blank on the feed line such that side panels of the blank extend transversely of the feed line. The device also includes positioning section for positioning one or more goods on a middle panel of the blank. The device includes a feed section for advancing the blank with the one or more goods along the feed line. A first folding section of the device is configured for folding upward side panels which lie diagonally of the middle panel. A second folding section of the device is configured for folding upward a rear panel and holding this panel in place as rear wall of the box. A third folding section of the device is configured for folding upward front panels by moving an arm upward from a first position under the feed line to a second position above the box, such that the box comes to lie under the upward moved arm in order to thus form a front wall and an upper wall of the box with the front panels.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Additional features and advantages of the disclosed embodiments will be set forth in the description which follows, and in part will be obvious from the description, or may be learned by the practice of the disclosure. These and other features will become more fully apparent from the following description and appended claims or may be learned by the practice of the present disclosure.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION

The present disclosure relates to packaging machines. More specifically, the present disclosure relates to methods and apparatus for forming customized packaging boxes from generic fanfold material. For example, in one embodiment of the present disclosure, a method of forming a box from a blank includes providing a blank on a drive line. The blank can include a plurality of panels, including a leading panel, an intermediate panel, a bottom panel, and a trailing panel. Each panel has one or more side flaps extending therefrom. In addition, each blank may or may not include one or more false scores extending thereacross. In such an embodiment, the method further includes moving the blank forward on the drive line and folding the side flaps up and down in an alternating fashion.

Embodiments of the present disclosure solve one or more of the problems in the art discussed above by providing methods and apparatus for forming boxes from box templates (or "blanks") that may or may not have false scores extending thereacross. The methods and apparatus described herein include steps and devices that rigidify various panels and flaps of the blanks formed from fanfold material so that false scores do not negatively affect the folding process or the structural integrity of the final box.

Figure 1:
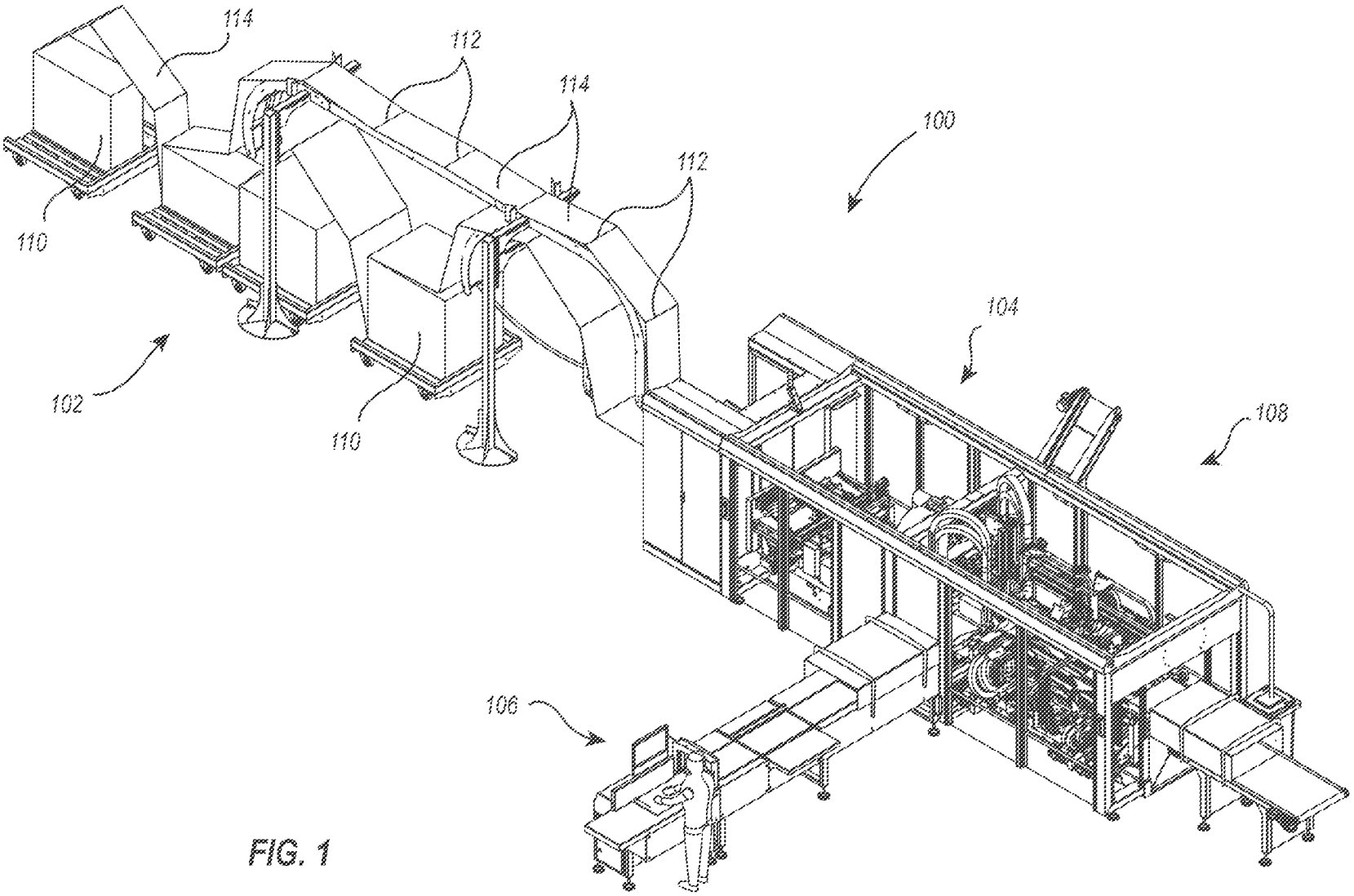
FIG. 1 illustrates an exemplary box forming machine and system, including a material feeder system, a blank cutting machine, a product supply machine, and a box forming machine.

Turning now to the figures, FIG. 1 illustrates an exemplary box forming machine and system 100, including a material feeder system 102, a blank cutting machine 104, a product supply machine 106, and a box forming machine 108. As seen in FIG. 1, the material feeder system 102 includes various stacks of fanfold material 110, which may be fed into the blank cutting machine 104. As noted above, the fanfold material 110 may include scores 112 where the material has been folded to form the stacks 110 of connected fanfold segments 114.

The fanfold material 110 illustrated herein may comprise corrugate, cardboard, or other packaging materials, or a combination thereof. While the fanfold material may comprise corrugate/cardboard, one or more other embodiments of fanfold stacks 110 may comprise materials other than corrugate/cardboard that may be used to form packages and boxes. For example, fanfold materials may comprise various plastics, rubbers, papers, or other bendable materials, or combinations thereof, which are generally known in the art of packaging and box forming.

Figure 2:
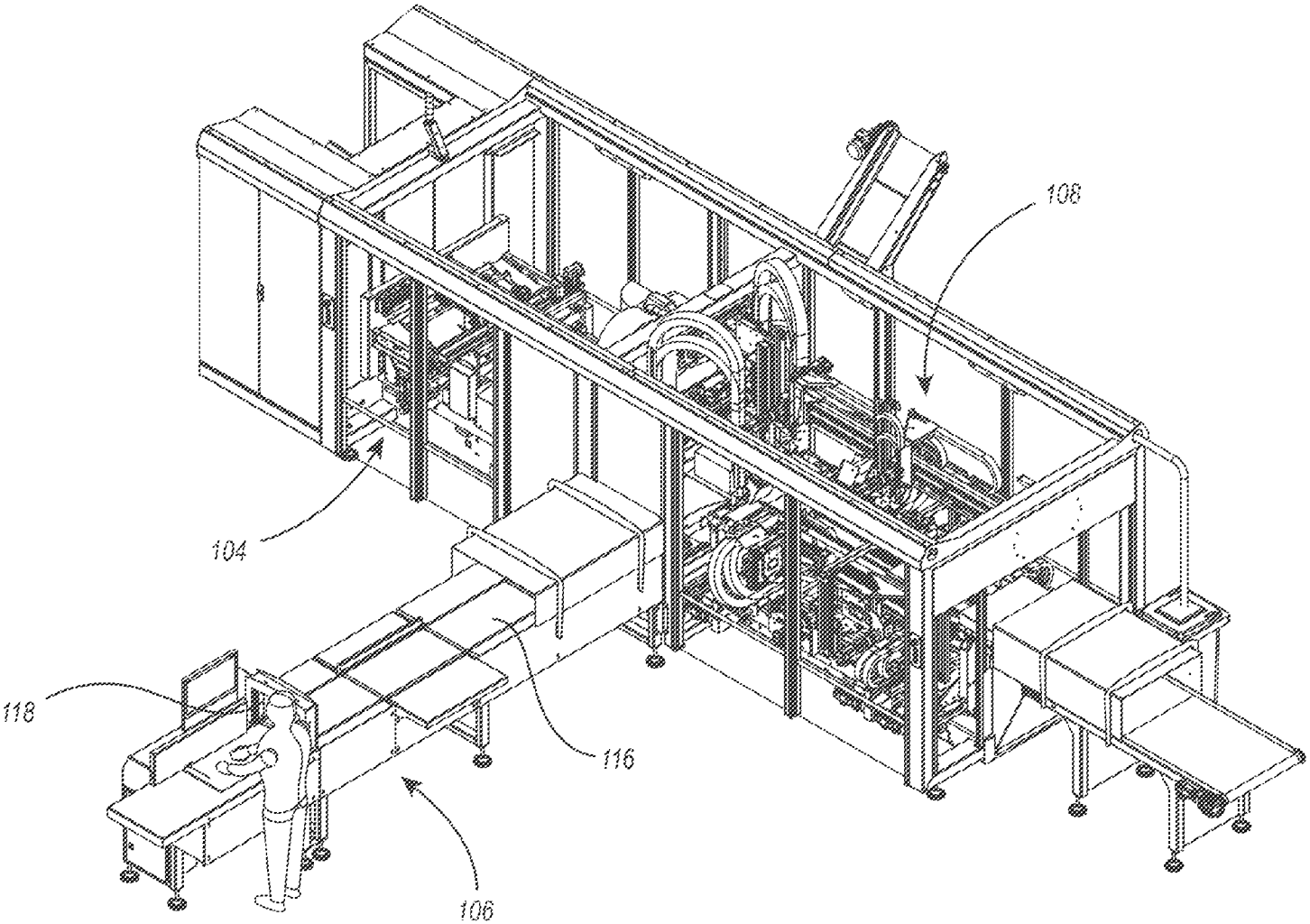
FIG. 2 illustrates a close-up view of the system illustrated in FIG. 1, including the product supply machine and the box forming machine.
Figure 3:
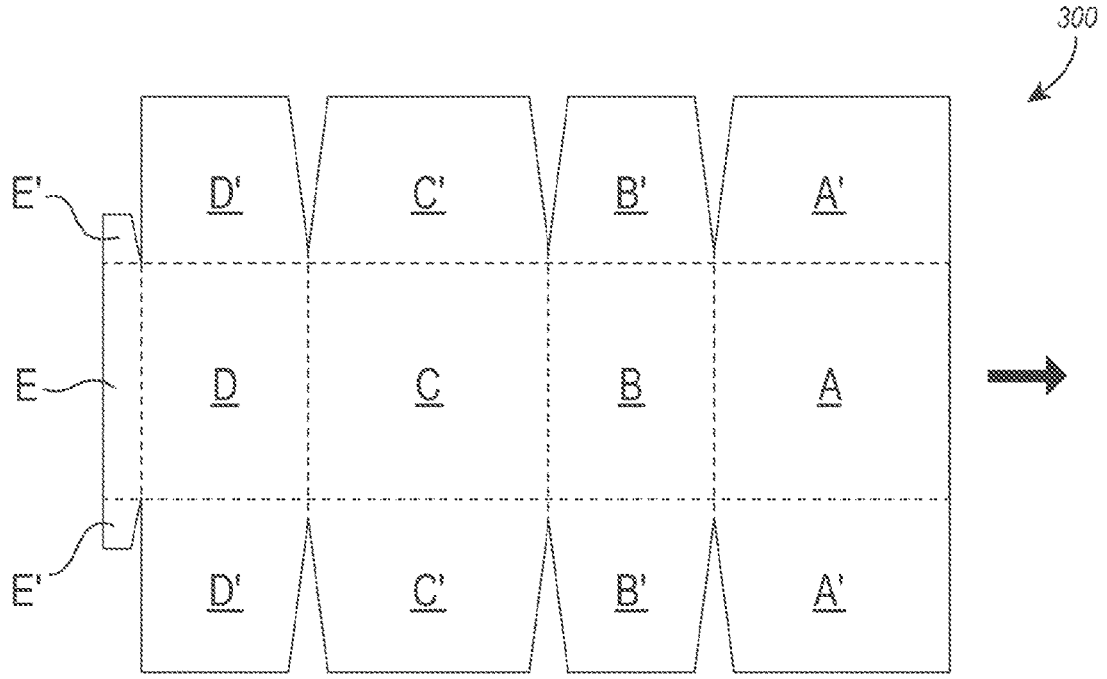
FIG. 3 illustrates an exemplary blank formed by a blank forming machine including a plurality of panels, side flaps, and a glue tab.

The fanfold material 110 is fed into the blank cutting machine to form a planar box template, or "blank," which is illustrated in more detail in FIG. 3. First, turning to FIG. 2, a closeup view of the blank cutting machine 104, product supply machine 106, and box forming machine 108 is shown. The blank cutting machine 104 transports a blank towards the box forming machine 108, which folds the blank into a box for packaging one or more goods. In the exemplary system illustrated in FIG. 2, the product supply machine 106 may comprise a conveyor belt 116 that feeds one or more goods onto the blank formed by the blank cutting machine 104 before the box forming machine 108 folds the blank into a box.

Additionally, the product supply machine 106 may include one or more scanners 118, including one or more dimensional and/or bar code scanners that determine the size of the one or more goods being packaged. This size information may then be relayed to the blank cutting machine 104, which in turn may cut a blank to optimal dimensions that minimize extra space around the one or more goods within the final box product. Once the one or more goods is/are placed on the proper area of the blank formed in the blank cutting machine 104, the one or more goods and the blank are transported into the box forming machine 108. As such, the box forming machine 108 may form a box around the one or more goods placed on the blank.

As noted above, a blank formed in the blank forming machine 104 may comprise a planar sheet of material having a plurality of panels, side flaps, and/or tabs that can be bent at various angles to form packaging boxes of various sizes and shapes. FIG. 3 shows one example of a blank 300 cut from a section of fanfold material 110 by the blank cutting machine 104. For reference, the arrow on the right of FIG. 3 indicates the forward direction in which the blank 300 moves through the box forming machine 108. In the illustrated example, the blank 300 comprises a leading panel A, an intermediate panel B, a bottom panel C, a trailing panel D, and a glue tab panel E. Each panel includes opposing side panels or flaps A'-E', respectively, which may extend transversely form either side of corresponding panels A-E.

The leading panel A is referred to as the "leading panel" because it is oriented in the forward direction as the blank 300 moves along through the box forming machine 108. Likewise, the trailing panel D indicates a panel that trails behind other panels as the blank 300 moves forward through the box forming machine 108. The bottom panel C is generally positioned where the one or more goods may be placed by the product supply machine 106. The bottom panel C may form the bottom surface of the final box.

The blank 300 illustrated in FIG. 3 is intended as a non-limiting example of one configuration of a blank. One will appreciate that the blank cutting machine 104 may form blanks of any number of shapes, sizes, and panel configurations to produce boxes that accommodate any number of product shapes and sizes. For example, in one or more embodiments, a blank may have more panels or less panels than those illustrated in FIG. 3. Also, in one or more embodiments, a blank may comprise panels having only one side panel extending therefrom, more than two side panels extending therefrom, or no side panels extending therefrom. In one or more embodiments, a blank may be formed that includes no glue tabs or two or more glue tabs positioned at various locations on the blank.

However, for purposes of illustrating and describing various embodiments of a box forming machine according to the present disclosure, the blank 300 illustrated in FIG. 3 will be the blank 300 illustrated in subsequent FIGS. 4-17. The dotted lines shown on the blank 300 of FIG. 3 may be illustrative only of boundaries between panels and/or tabs where the box forming machine 108 may bend the blank 300 to form a box. In one or more embodiments of the present disclosure, the blank cutting machine 104 may score, depress, crease, or otherwise affect the material at the boundary lines of the blank 300 to form weaknesses in the material. In this way, the blank is more likely to bend at the boundary lines illustrated when the side panels A'-E' or panels A-E are manipulated by the box forming machine 108. The illustrated blank 300 is configured to form a rectangular shaped box, as will be apparent from the following description and figures.

FIGS. 4 through 17 illustrate various steps of a method of forming a box in the box forming machine 108 and components of the box forming machine 108 that fold the blanks into the boxes. In these figures, the blank 300 is shown moving forward through the box forming machine 108 without any goods or products placed thereon for illustrative purposes. However, it is understood, as discussed above, that one or more goods may be place onto the blank before the blank moves through the box forming machine 108 so that a box is formed around the goods. In particular, in the embodiment of the blank 300 illustrated herein, one or more goods may be place on the bottom panel C, which forms the bottom surface of the box being formed.

Figure 4:
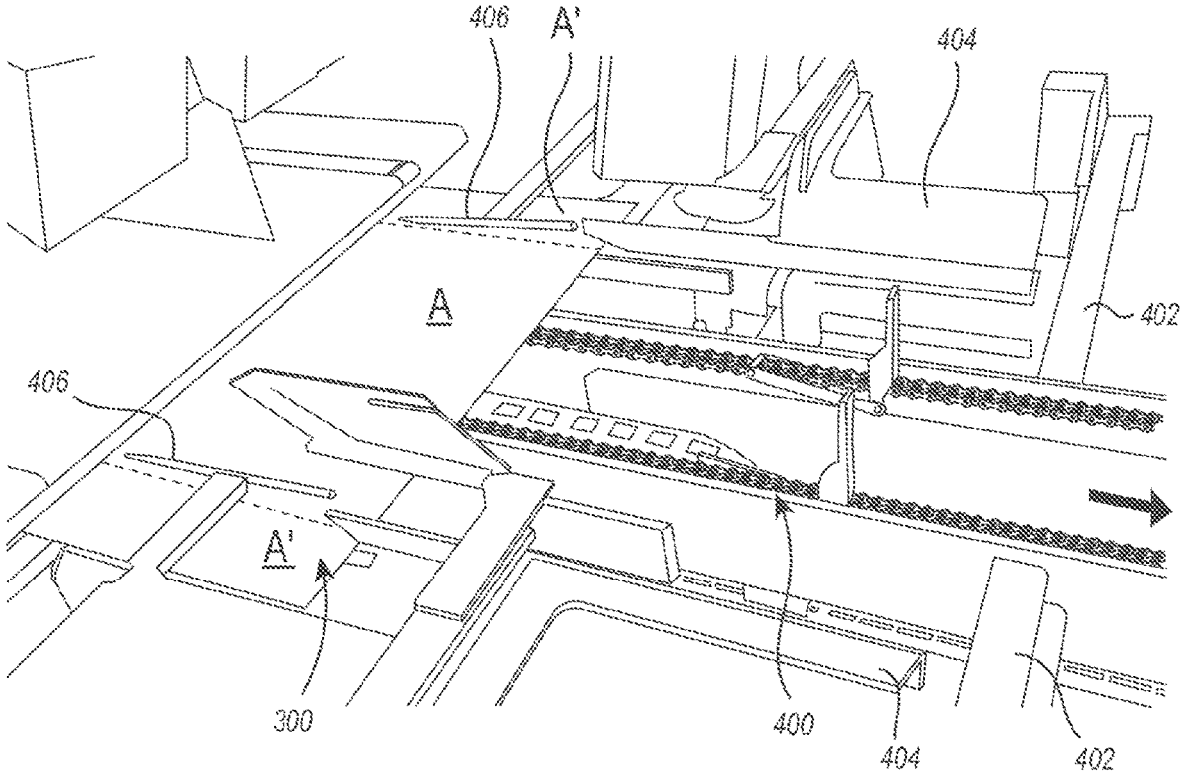
FIG. 4 illustrates a drive line of a box forming machine, the drive line carrying a blank forward along a conveyor belt, and a plurality of arms, holders, and side flap fingers.

FIG. 4 illustrates an interior portion of the box forming machine 108 with the blank 300 entering the box forming machine 108 from the left. For reference, the direction referred to as the "forward" direction herein is illustrated from left to right in FIG. 4 and subsequent figures. The box forming machine 108 may comprise a drive line 400 that carries the blank 300 forward through the box forming machine 108. To this end, the drive line 400 may comprise one or more drive mechanisms that carry the blank 300 forward along the drive line 400. One or more embodiments may comprise different drive mechanisms, such as conveyor belts, chains, rolling surfaces, rails, or the like, or combinations thereof.

The box forming machine 108 may also comprise one or more arms 402, holders 404, and side panel fingers 406, all of which will be described in more detail with reference to subsequent figures. As shown in FIG. 4, the blank 300 may enter the box forming machine 108 in a planar fashion as it begins to move forward along the drive line 400. For example, as shown in FIG. 4, the leading panel A and associated side panels A' are generally planar as the blank 300 enters the box forming machine 108.

Figure 5:
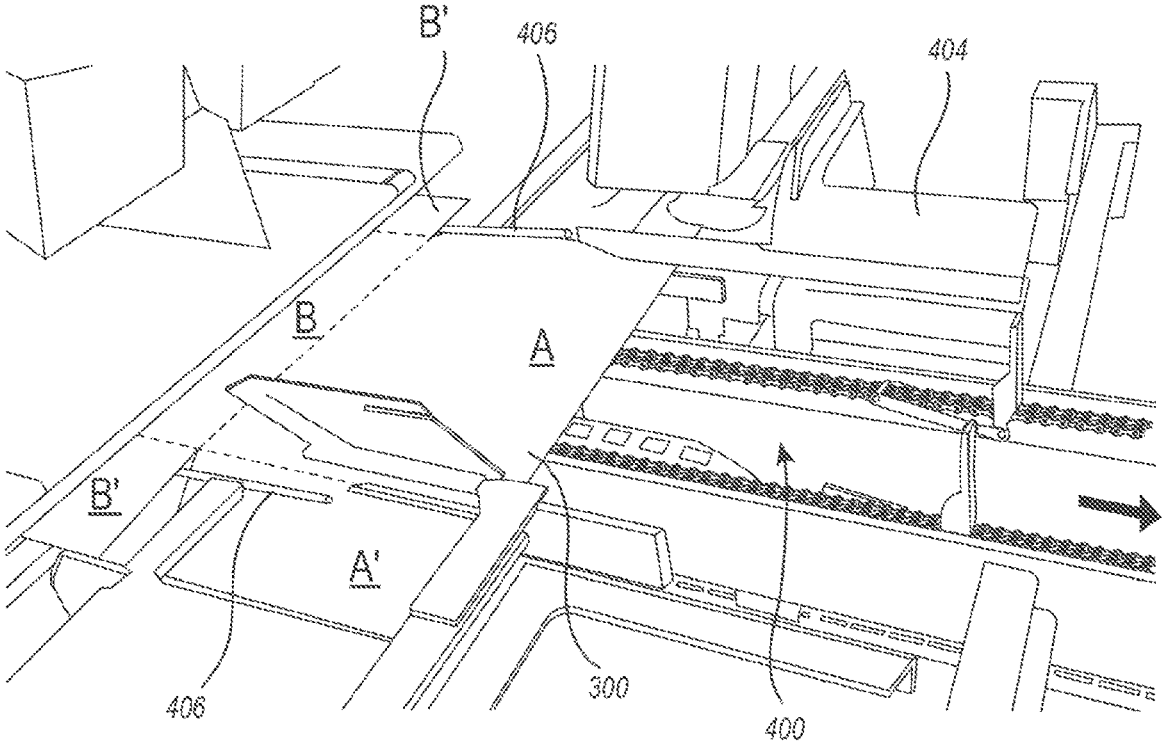
FIG. 5 illustrates the blank advanced further down the drive line with a side flap finger folding a first set of side flaps down as the blank moves forward on the drive line.
Figure 6:
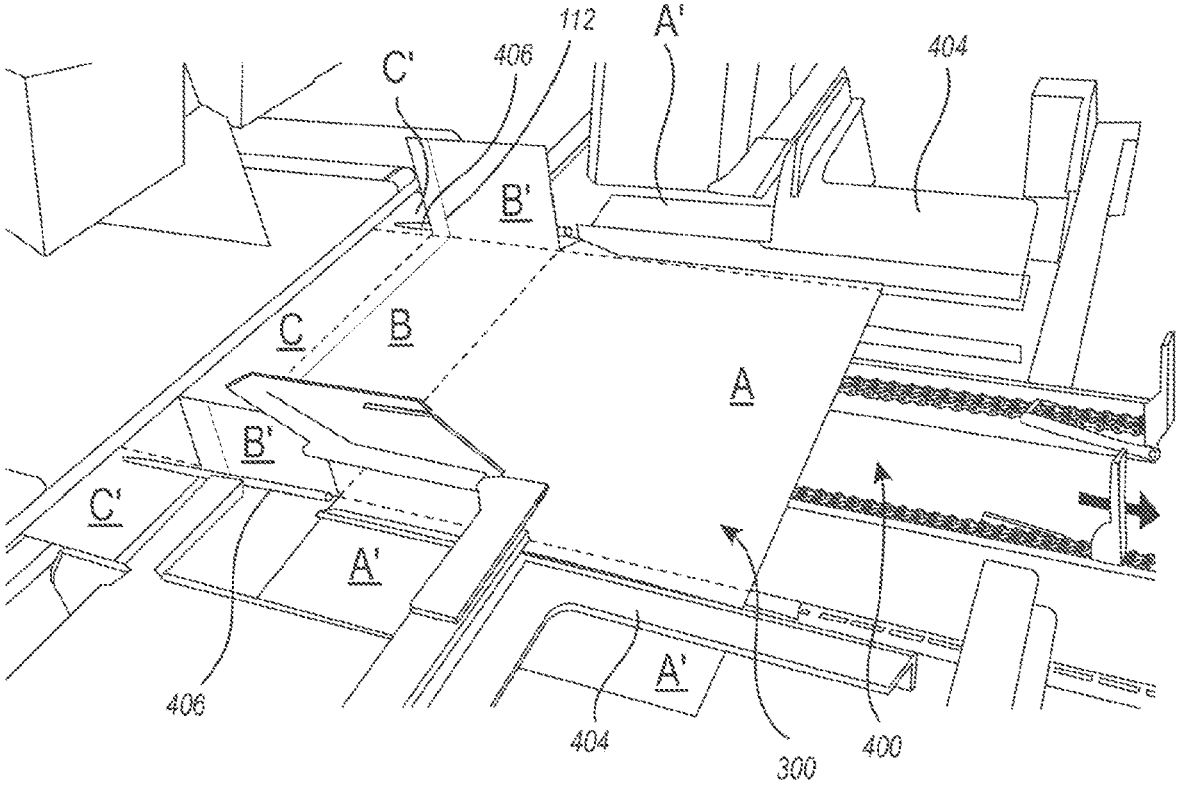
FIG. 6 illustrates the blank advanced further down the drive line, the side flaps finger folding a set of side panels up as the blank moves forward on the drive line.

However, the side panel fingers 406 may push the side panels A'-E' up and down in alternating fashion as the blank 300 moves forward along the drive line 400. For example, as shown in FIG. 5, the side panel fingers 406 may move up and down as the drive line 400 moves the blank 300 forward so that side panels A' and are pushed down and the side panel fingers 406 are positioned below side panels B'. Subsequently, as shown in FIG. 6, the side panel fingers 406 may move up as the blank 300 moves forward on the drive line 400 to lift side panels B' at an angle relative to the intermediate panel B of the blank 300. Once the side panel fingers 406 move up again, as shown in FIG. 6, the side panel fingers 406 may then be positioned above side panels C'.

As described herein, folding the side flaps up and down in an alternating fashion means that alternating side flaps are folded up and down. In other words, one side flap is folded down and the adjacent or subsequent side flap is folded up, and so on. As a result, every other side flap is folded up and every other side flap is folded down.

When a side panel is pushed down or lifted up by the side panel fingers 406, such as side panels A' and side panels B', shown in FIGS. 5 and 6, respectively, the panels from which the side panels extends may be rigidified. For example, because side panels B' are lifted up, the intermediate panel B from which side panels B' extend is rigidified. The intermediate panel B, being rigidly secured to side panels B', is less likely to bend or otherwise fail at a location other than the boundary therebetween because the side panels B' extending therefrom are folded and are no longer co-planar with the intermediate panel B. Likewise, the side panels A' that are folded/bent downward, may rigidify the leading panel A from which they extend. The same is true for the other panels A-E as the side panels A'-E' are bent up and down in alternating fashion as the blank 300 moves forward on the drive line 400.

Rigidifying the panels A-E as the blank 300 moves forward on the drive line 400 may strengthen the panels A-E and ensure that the panels A-E are bent or folded at the proper boundary lines between adjacent panels during subsequent blank folding methods and steps of the box forming process described herein. Along these lines, rigidifying various panels of the blank 300 may reduce the risk of panels bending or folding along false scores that extend across the blank 300 at locations other than the boundaries between panels.

FIG. 6 illustrates an example of a false score 112 extending across the blank 300. As seen in FIG. 6, the blank 300, which was cut from fanfold material 110, extends across a fanfold score 112 creating a "false score" on the blank 300. The false scores 112 of the blank 300 may form weaknesses in the blank material that causes panels A-E and side panels A'-E' to erroneously bend or fold during the box forming process. However, due to the side panels B' being lifted up at an angle by the side panel fingers 406, the intermediate panel B and the side panels B' may be rigidified. That is, the intermediate panel B may tend to bend at the proper boundary between adjacent panels A and C, rather than bending along the false score 112, due to the angle of the side panels B' relative to the intermediate panel B.

Likewise, as shown in FIGS. 5 and 6, the leading panel A is rigidified due to the side panels A' extending therefrom being bent down at an angle relative to the leading panel A. As the blank 300 moves forward along the drive line 400, the holders 404 may maintain panels that have been folded down in their flat position. For example, the holder 404 illustrated in FIG. 6 comprises a bottom edge that sits atop the side panel A' as the blank 300 moves forward along the drive line 400. In one or more embodiments, the holders 404 may be stationary. In one or more other embodiments, the holders 404 may be manipulated temporarily or permanently to adjust to the needs of various blanks and panel configurations. As will be apparent in subsequent figures, the holders 404 may also maintain the position of side panels A'-E' that have been folded upward as the blank 300 moves forward on the drive line 400.

Figure 7:
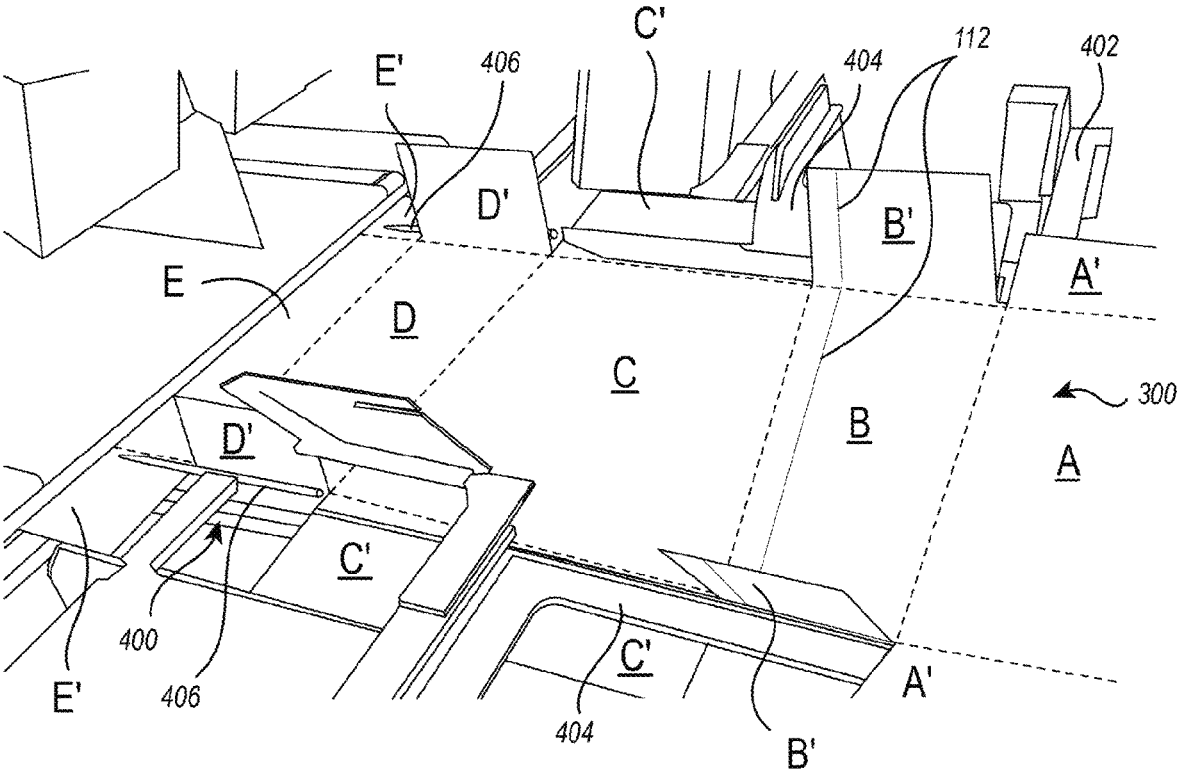
FIG. 7 illustrates the blank advanced further down the drive line, the plurality of side flaps being folded up and down in an alternating fashion and the various panels and side flaps being held in place by the holders as the blank moves forward on the drive line.

FIG. 7 illustrates the blank 300 moved further down the drive line 400 from that shown in FIG. 6. FIG. 7 illustrates the side panel fingers 406 pushing the side panels D' upward to rigidify trailing panel D. As shown, side panels A' have been folded down, side panels B' have been folded up, side panels C' have been folded down, side panels D' have been folded up, and side panels E' may be folded down. In this way, the side panel fingers 406 may fold the side panels A'-E' up and down in alternating fashion while the holders 404 maintain the positions of the side panels A'-E', either upward or downward (or flat), as the blank 300 moves forward along the drive line 400.

Figure 8:
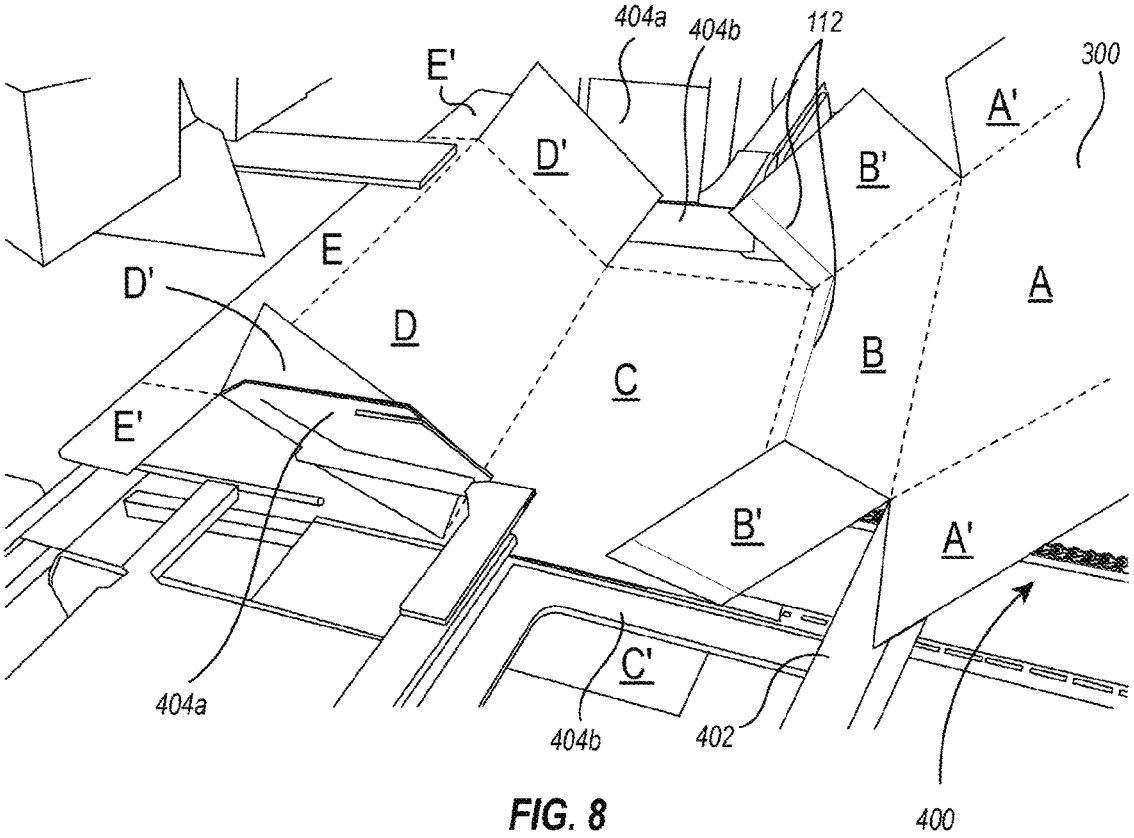
FIG. 8 illustrates arms of the box forming machine raising panels of the blank to form front and rear surfaces of a box.

Once the side panels A'-E' have been folded to rigidify respective panels A-E, the blank 300 may then undergo several bending/folding steps to form a box. As shown in FIG. 8, once the leading panel A extends fully beyond the front edges of the holders 404, one or more arms 402—over which the leading panel A and the intermediate panel B have passed—may be raised up as the blank 300 moves forward along the drive line 400. When the arms 402 lift the leading panel A and the intermediate panel B as shown, the blank 300 may be bent along the boundary between the intermediate panel B and the bottom panel C, rather than along the false score 112 shown. Thus, the rigidifying of the panels A-E due to the side panels A'-E' being folded up and down ensures that any false scores 112 that may extend transversely across the blank 300 do not negatively affect the folding steps of the box forming machine 108.

Also, as shown in FIG. 8, the trailing panel D and glue tab panel E may be lifted/folded upward by one or more trailing squaring arms that may rise above the drive line 400 from beneath the panels D and E. The trailing panel D and glue tab panel E may be lifted/folded upward simultaneously with, just prior to, or just after the leading panel A and intermediate panel B are lifted by the arms 402.

The holders 404, which may include upper and lower portions 404*a* and 404*b*, may maintain various side panels A'-E' in position during the folding step illustrated in FIG. 8. In addition, the holders 404 may hold the bottom panel C down while the other panels A, B, D, and E are lifted by the arms 402 and trailing squaring arms. In this way, the blank 300 is not lifted off the drive line 400 during the folding steps described herein.

Also, in one or more embodiments of the present disclosure, the leading bottom corners of the holders 404 may be chamfered or angled. In such embodiments, the arms 402 may begin to lift the leading and intermediate panels A, B up before the leading panel A and/or intermediate panel B have moved completely beyond the front edge of the holders 404 by the drive line 400. In such an embodiment, the chamfered corner of the holders 404 may increase the speed of forming a box from the blank 300 in the box forming machine 108 because the arms may begin lifting/folding the leading and intermediate panels A, B sooner than if the leading and intermediate panels A, B had to be completely past the holders 404 before the arms 402 could begin to lift/fold the leading and intermediate panels A, B.

Figure 9:
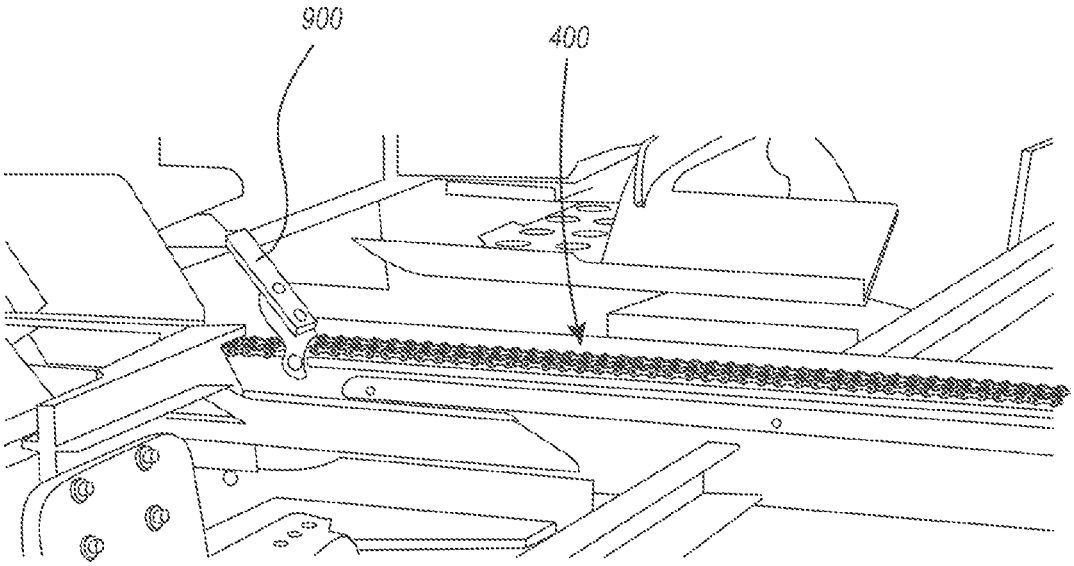
FIGS. 9 and 10 illustrate the drive line of the box forming machine without the blank to show a set of trailing squaring arms raising up as the trailing squaring arms move forward along the drive line.
Figure 10:
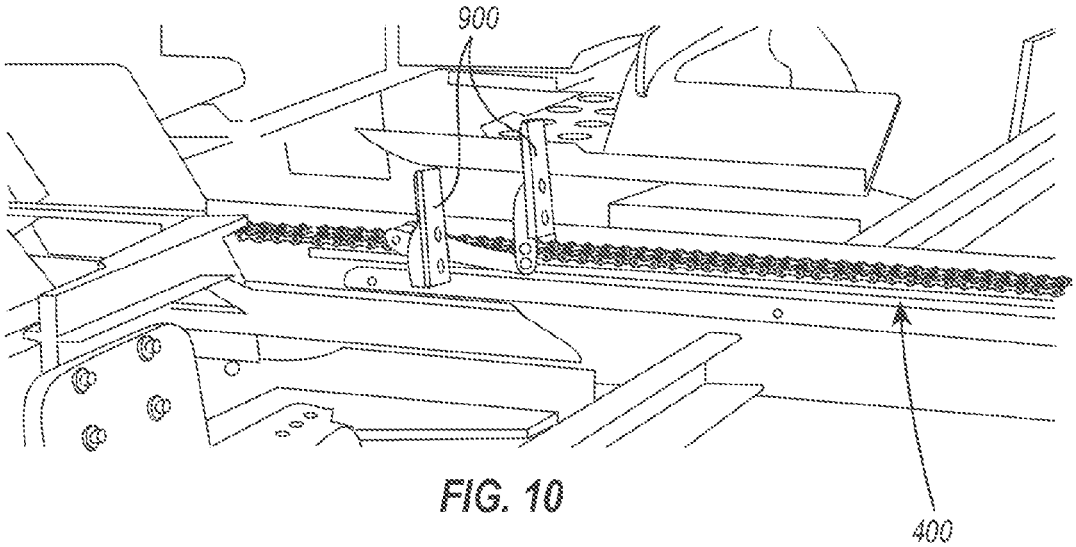

The trailing squaring arms mentioned above with reference to FIG. 8, which lift the trailing panel D and glue tab panel E, are not shown because of the blank 300 disposed on the drive line 400. However, FIG. 9 illustrates the drive line 400 without the blank 300 thereon to show an embodiment of the trailing squaring arms 900. Before the trailing squaring arms 900 lift the trailing panel D and glue tab panel E of the blank 300, the trailing squaring arms 900 may lie flush with or below the drive line 400. FIG. 9 illustrates the trailing squaring arms 900 as they begin to rise up above the drive line 400 to lift the trailing panel D and the glue tab panel E upward. In one or more embodiments, the trailing squaring arms 900 may extend upward until they are upright as shown in FIG. 10.

Figure 11:
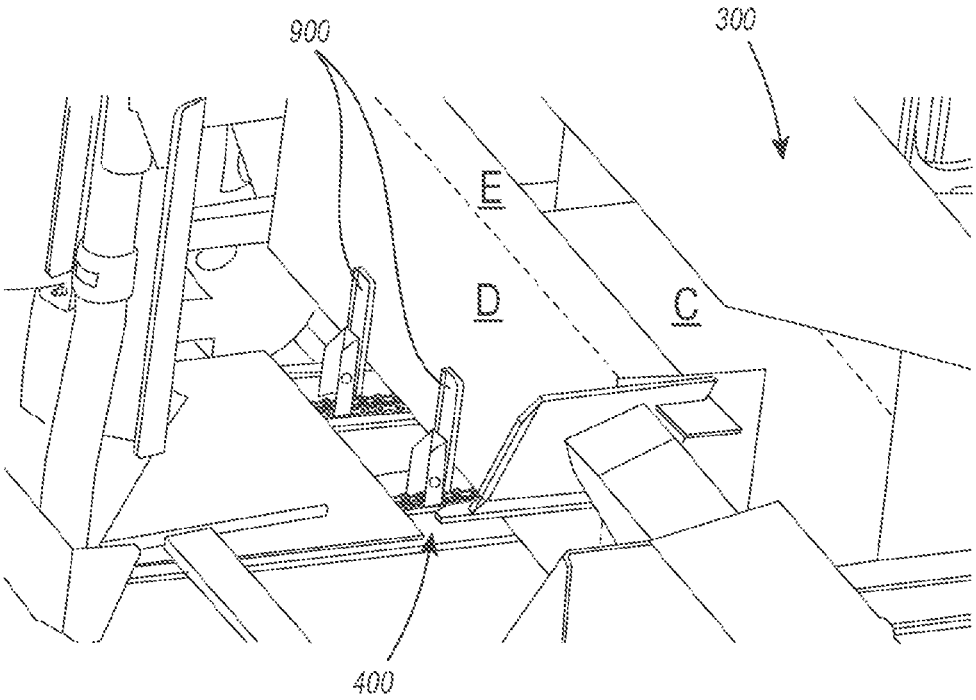
FIG. 11 illustrates a rear perspective view of a set of trailing squaring arms on a drive line maintaining a bottom rear corner of a box at an angle as the blank moves forward on the drive line.

In one or more embodiments, the box forming machine 108 may include only one trailing squaring arm 900 or more than two trailing squaring arms 900. In addition, in one or more embodiments of the present disclosure, the trailing squaring arms 900 may extend upward at any number of angles, depending on the shape of the box being formed and the required angle of the trailing panel D relative to the bottom panel C. Along these lines, FIG. 11 illustrates a perspective view of a set of trailing squaring arms 900 extended upward with a blank 300 on the drive line 400. As shown, the trailing squaring arms 900 extend upward above the drive line 400 to bend the trailing panel D and bottom panel C at an angle relative to each other along the border between the panels D, C. In one or more embodiments of the present disclosure, the trailing squaring arms 900 shown may move along the drive line 400 with the blank 300 to maintain the bottom trailing corner of the box as the blank 300 moves forward.

Figure 12:
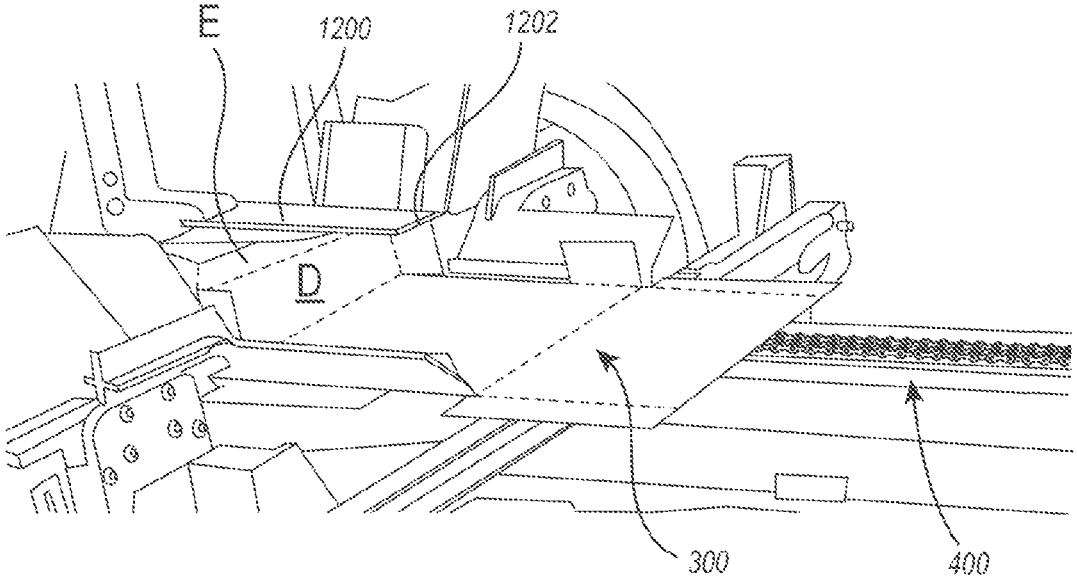
FIG. 12 illustrates a spatula arm of the box forming machine folding a glue tab down as the blank moves forward on the drive line.

Turning now to FIG. 12, the box forming machine 108 may also comprise a spatula 1200 that extends downward to fold the glue tab panel E down as the blank moves forward along the drive line 400. The spatula may fold the glue tab panel E downward simultaneously with the trailing panel D being lifted up. In one or more other embodiments, the spatula 1200 may fold the glue tab panel E downward after the trailing panel D is lifted up. Also, the spatula 1200 may comprise a leading edge 1202 that extends transversely across the drive line 400.

Figure 13:
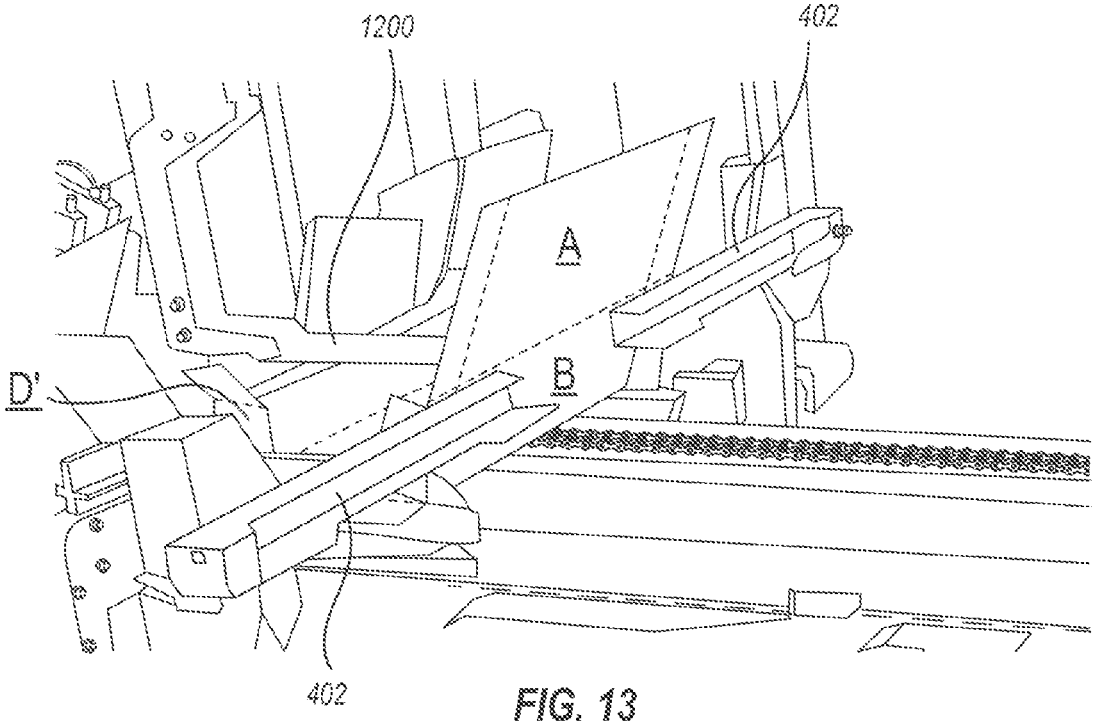
FIG. 13 illustrates a set of arms of the box forming machine folding panels of the blank up to form a front surface of the box as the blank moves forward on the drive line.
Figure 14:
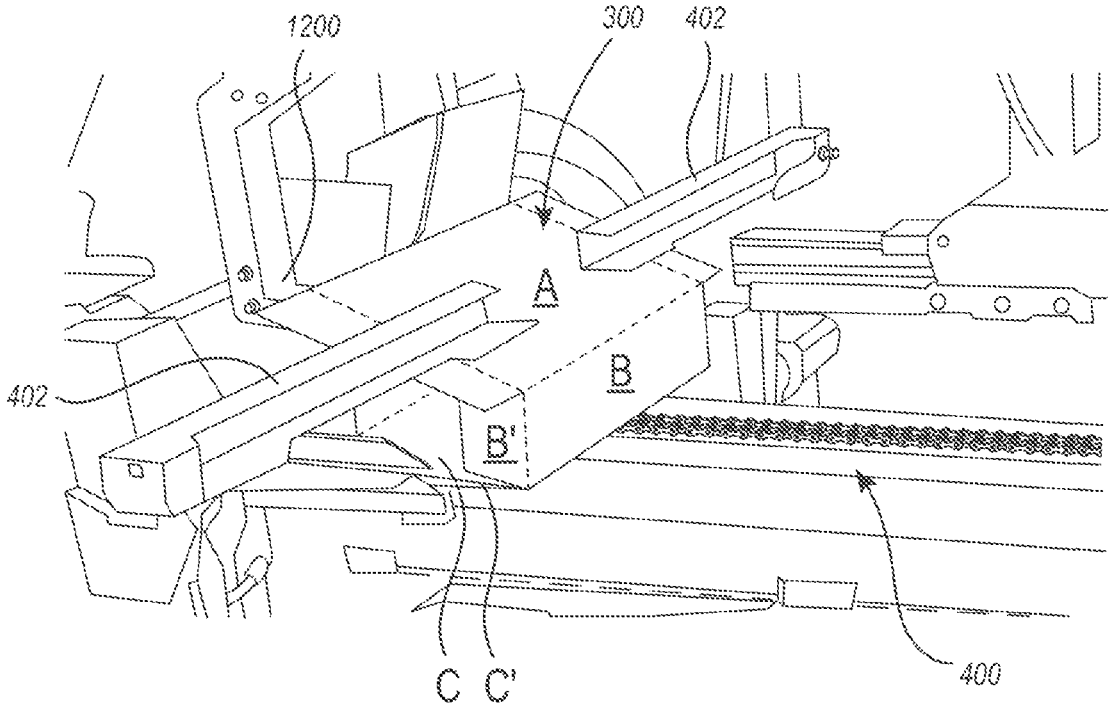
FIG. 14 illustrates the set of arms illustrated in FIG. 13 folding a leading panel of the blank down to form a top surface of the box as the blank moves forward on the drive line.

As shown in FIG. 13, the leading edge 1202 of the spatula 1200, which is hidden by panel A being lifted upward by the arms 402, may extend toward and contact the boundary between the leading panel A and the intermediate panel B. As the blank 300 moves forward along the drive line 400, as shown in FIG. 14, the arms 402 may continue to raise upward over the boundary between the leading panel A and the intermediate panel B. As the arms 402 rise upward in this manner, the leading edge of the spatula 1200 may contact the boundary between the leading panel A and the intermediate panel B so that the leading panel A bends relative to the intermediate panel B along the leading edge 1202 at that boundary.

One will also appreciate that the bent side panels B' extending from the intermediate panel B may also facilitate the proper folding position between the leading and intermediate panels A, B. For example, as shown in FIG. 14, the side panel B', which was folded upward, contacts the bottom panel C and/or the side panel C' to prevent the intermediate panel B from bending any further as the arms 402 push down on the leading panel A. The same is true for the side panel D' extending from the trailing panel D as the trailing panel D is pushed upward, and the glue tab panel E is pushed downward by the spatula 1200, as described above. Thus, bending the side panels A'-E' as described herein may also function to ensure proper bending of the blank 300 as the arms 402, the trailing squaring arms 900, and the spatula 1200 push on the various panels A-E.

Figure 15:
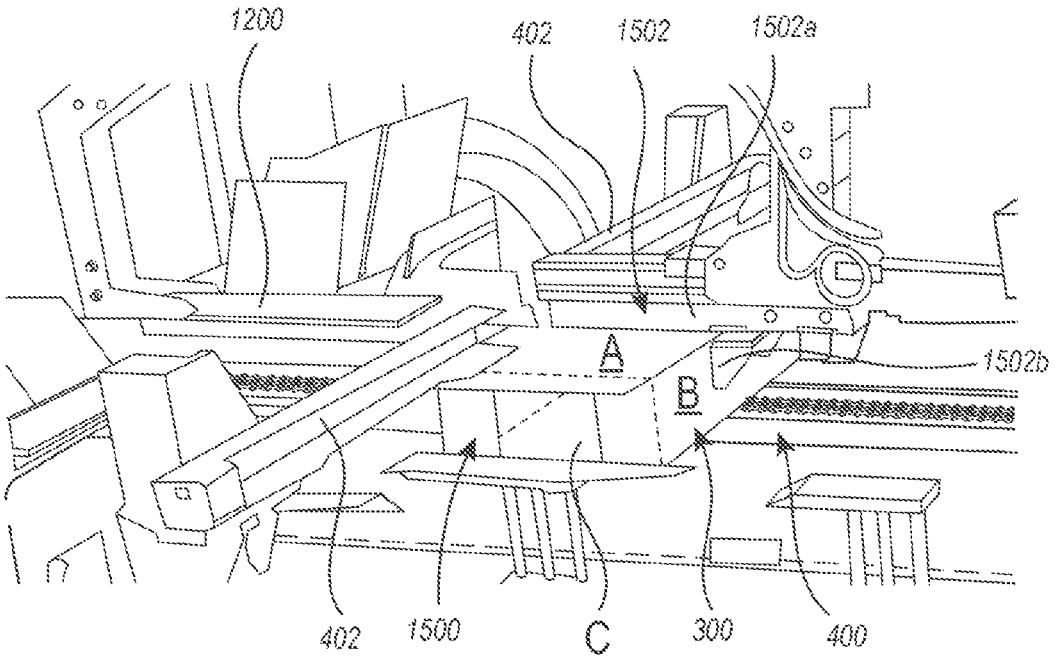
FIG. 15 illustrates a leading squaring arm of the box forming machine maintaining a top front corner of the box at an angle as the blank moves forward on the drive line.

As shown in FIG. 15, as the blank 300 moves forward along the drive line 400, the arms 402 may travel along the leading panel A of the blank 300 and press the leading panel A down against the glue tab panel E, which has been folded down by the spatula 1200. As this occurs, the spatula 1200 may be withdrawn from between the glue tab panel E and the leading panel A. In one embodiment, the spatula 1200 may retreat just prior to the leading panel A contacting the glue tab panel E. In another embodiment, the spatula 1200 may retreat just after the leading panel A contacts the glue tab panel E. In yet another embodiment, the spatula 1200 may retreat simultaneously with the leading panel A contacting the glue tab panel E.

As shown in FIG. 15, once the leading panel A has been folded downward by the arms 402, the leading panel A may form the top surface of a box 1500. Along these lines, the intermediate panel B may form the front surface of the box 1500, the bottom panel C may form the bottom surface of the box 1500, and the trailing panel D may form the rear surface of the box 1500.

Also, as shown in FIG. 15, the box forming machine 108 may comprise a leading squaring arm 1502. Once the leading panel A has been pushed down to form the top surface of the box 1500, the leading squaring arm 1502 may extend downward and contact the top surface and front surface of the box 1500. Accordingly, in one embodiment, the leading squaring arm 1502 may comprise a first component 1502*a* configured to contact the top surface and a second component 1502*b* configured to contact the front surface. In the illustrated embodiments, which shows a rectangular shaped box 1500 formed from the blank 300, the first and second components 1502*a*, 1502*b* are disposed at a 90-degree angle relative to one another. In such an embodiment, the leading squaring arm 1502 may maintain the top leading corner of the box 1500 at a 90-degree angle as the blank moves forward along the drive line 400.

However, one will appreciate that the first and second components of the leading squaring arm 1502 may be disposed at various other angles relative to one another depending on the shape of the box being formed. For example, in one or more embodiments, the box forming machine 108 may form boxes that are not rectangular shaped. In such embodiments, the leading squaring arm 1502 may have first and second components 1502*a*, 1502*b* that are angled greater or less than 90-degrees relative to one another. In addition, while the embodiment illustrated in the figures shows one leading squaring arm 1502, one or more other embodiments of the box forming machine 108 may comprise more than one leading squaring arm 1502.

Likewise, as discussed above, the trailing squaring arms 900 may extend upward from the drive line 400 vertically to maintain the trailing bottom corner of the box 1500 at a 90-degree angle as the blank 300 moves forward along the drive line 400. However, as with the leading squaring arm 1502, the trailing squaring arms 900 may be disposed at angles other than 90-degrees relative to the drive line 400 to form corners of boxes other than rectangular shaped boxes.

Figure 16:
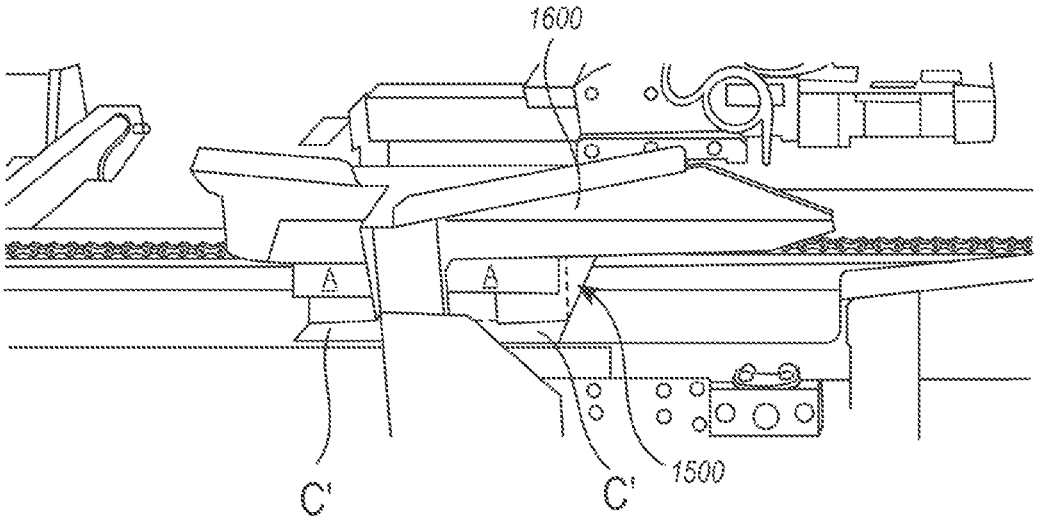
FIG. 16 illustrates an upper side arm of the box forming machine folding down a side flaps of the blank to form a side surface of the box as the blank moves forward on the drive line.
Figure 17:
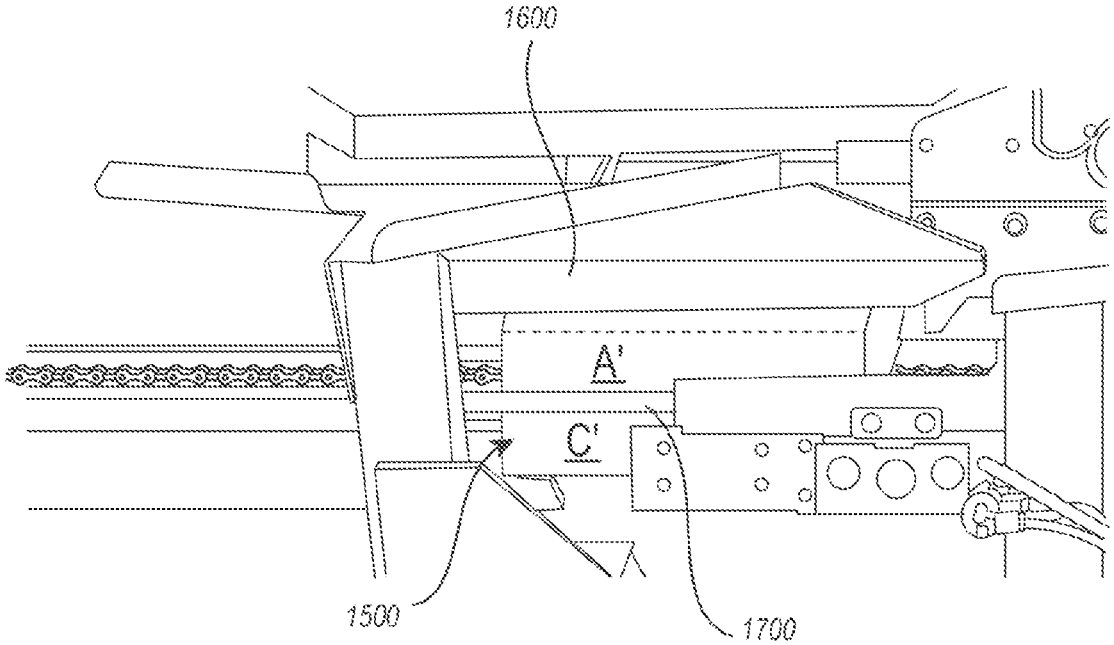
FIG. 17 illustrates a lower side arm of the box forming machine folding up a side flaps of the blank to form a side surface of the box as the blank moves forward on the drive line.

The box forming machine 108 may also comprise upper and lower side arms configured to fold the remaining side panels of the blank 300 to form right and left side surfaces of the box 1500. FIGS. 16 and 17 illustrate upper and lower side arms 1600, 1700, respectively. The upper side arm 1600 may move down while contacting the side panel A' extending from the leading panel A to fold the side panel A' down to form at least a portion of the right surface of the box 1500. Likewise, the lower side arm 1700 of the box forming machine 108 may extend upward while contacting the side panel C' extending from the bottom panel C to fold the side panel C' to form at least a portion of the right surface of the box 1500. Likewise, opposing upper and lower side arms 1600, 1700 may form the left surface of the box 1500 by similarly folding various side panels to form the left surface of the box 1500.

One will appreciate that during the various folding steps described herein, one or more methods may be provided to adhere the various panels together while forming the box 1500. For example, in one or more embodiments, the box forming machine 108 may include the step of applying glue or other adhesive material to the glue tab panel E. Additionally or alternatively, the box forming machine 108 may include means to apply glue or other adhesive material to at least a portion of the leading panel A. In such embodiments, the leading panel A and glue tab panel E may adhere to one another when they are brought into contact.

Likewise, one or more embodiments of the box forming machine 104 of the present disclosure may comprise means to apply glue or other adhesive materials to the various side panels that form the left and right surfaces of the box 1500. In this way, the box may remain intact after the panels of the blank are bent/folded into position along the drive line 400 of the box forming machine 108, as described herein.

One will appreciate that the various components of the box forming machine 108 described herein may comprise components, shapes, and configurations, or be disposed at different angles or distances relative to one another, other than those described herein, while maintaining their proper functions described herein. For example, the arms 402 extending transversely across the drive line 400 are illustrated as elongated, rectangular bars. However, one or more other embodiments of the arms 402 may include one or more rod shaped bars, planar plates, or irregularly shaped components.

Also, for example, while the arms 402 are illustrated as extending transversely across the drive line 400 in a perpendicular fashion, one or more embodiments may include arms 402 that extend across the drive line 400 in a non-perpendicular fashion.

Also, for example, while the present disclosure illustrates the side panel fingers 406 comprising generally circular rods tapering towards the trailing ends thereof, one or more other embodiments may comprise side panel fingers 406 of other shapes and/or sizes. For example, in one or more other embodiments, the side panel fingers may comprise rectangular rods, plates, or other irregularly shaped components that are capable of performing the same functions described herein.

Also, for example, the drive line, spatula, trailing squaring arms, leading squaring arms, and holders of the present disclosure may comprise shapes and components other than those described herein or be positioned at angles other than those shown. These components of other embodiments may perform the same functions as those described herein.

For example, the spatula 1200 and leading squaring arms 1502 are illustrated as extending downward from above the drive line 400. However, in one or more embodiments, the spatula 1200 and/or leading squaring arms 1502 may extend from below or to the side of the drive line 400 to perform their described functions. Also, for example, the spatula 1200 and/or leading squaring arms 1502 may extend at an angle relative to the drive line 400, rather than parallel in the longitudinal direction of the drive line 400 as illustrated herein.

One will also appreciate that the various steps and folding processes carried out by the box forming machine 108 described herein may vary in other embodiments. Again, the blank 300 shown herein for illustrative purposes may be altered to form boxes of various other shapes and sizes. Accordingly, the steps, folding processes, and order with which these steps are carried out may be rearranges, altered, or discarded in one or more other embodiments of the present disclosure.

For example, in one or more embodiments, the blank 300 may not comprise a glue tab panel E. In such an embodiment, the box forming machine 108 may or may not comprise a spatula as described herein. Also, for example, in one or more embodiment of the present disclosure, the box being formed by the box forming machine 108 may be an open box having one or more surfaces open. In such an embodiment, the box forming machine 108 may or may not include one or more upper and lower side arms to form left and/or right surfaces of the box. Likewise, in such an embodiment, the box forming machine 108 may or may not raise a leading panel over the top of the one or more goods to form an open top of the box 1500.

Figure 18:
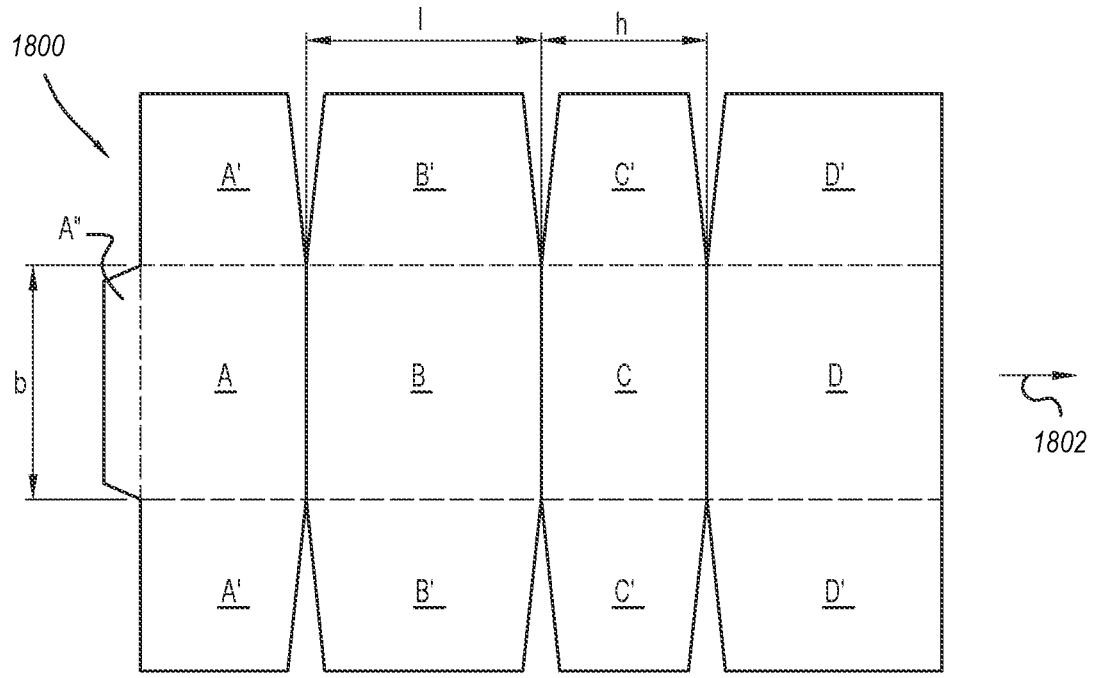
FIG. 18 illustrates an example box blank according to one embodiment of the present disclosure.

Attention is now directed to FIGS. 18-21, while illustrate another box blank and methods and devices for folding the box blank into a box. For instance, FIG. 18 shows a blank 1800. Blank 1800 is shown in top view in FIG. 18. The blank 1800 is similar or identical in many respects to blank 300. For instance, the blank 1800 has four central panels A, B, C and D. Each of the four central panels is provided to form a wall of the box. In the configuration of FIG. 18, panel B forms the lower wall of the box, panels A and C form upright walls of the box, and panel D forms the upper wall of the box. The Figure also indicates how the length 1, width b, and height h of the box follow from the dimensions of blank 1800. This will be apparent to the skilled person and will not be further elucidated.

Each of the panels A, B, C and D has two side flaps, designated respectively with A', B', C' and D'. These side flaps are provided to form the two side walls of the box. In the present embodiment, a closing flap A" is further provided on panel A in the direction of movement 1802 or longitudinal direction of blank 1800. This closing flap A" serves to connect panel A to panel D when the box is being formed. This will be further elucidated with reference to the following figures. In FIG. 18, closing flap A" is formed as a flap which protrudes in the longitudinal direction of panel A. Alternatively, closing flap A" can also be provided with corresponding side flaps so that closing flap A" extends over the whole width of the blank. The advantage hereof is that no waste pieces need to be discharged.

In FIG. 18, a wedge-shaped piece of material has been cut away between adjacent side flaps. In practice this is advantageous in some cases in the folding of the side flaps. This is the embodiment which is shown in FIG. 18, since it clearly illustrates the side flaps. A method according to the present disclosure also allows use to be made of a blank 1800 in which the adjacent side flaps are separated from each other only by a single cut, and wherein a wedge of material has not been cut away. In other words, the side flaps in blank 1800 can be formed by a straight cut in the transverse direction of blank 1800, starting at an edge of the blank and extending toward a central axis of the blank over a length equal to the length of the side flaps. The skilled person will further appreciate that the side flaps A', B', C' and D' can be dimensioned to fully form or partially form the side panel. When the side panel has been only partially formed, the side panel will typically have an opening in the centre, whereby the box is not fully closed. This is advantageous in some situations. When the side panel has been fully formed, the side flaps can be adjoining or overlapping. Different combinations hereof are possible.

A blank can be created in order to form a box with predetermined dimensions. The creating of the blank itself may for performed in a variety of ways. Blanks as shown in FIG. 18 can be made to the size of the goods to be packaged. The blank shown in FIG. 18 will be referenced in the following description for how to fold a blank. It will be appreciated, however, that the blanks 1800 and the following discussion are merely exemplary.

Figure 19:
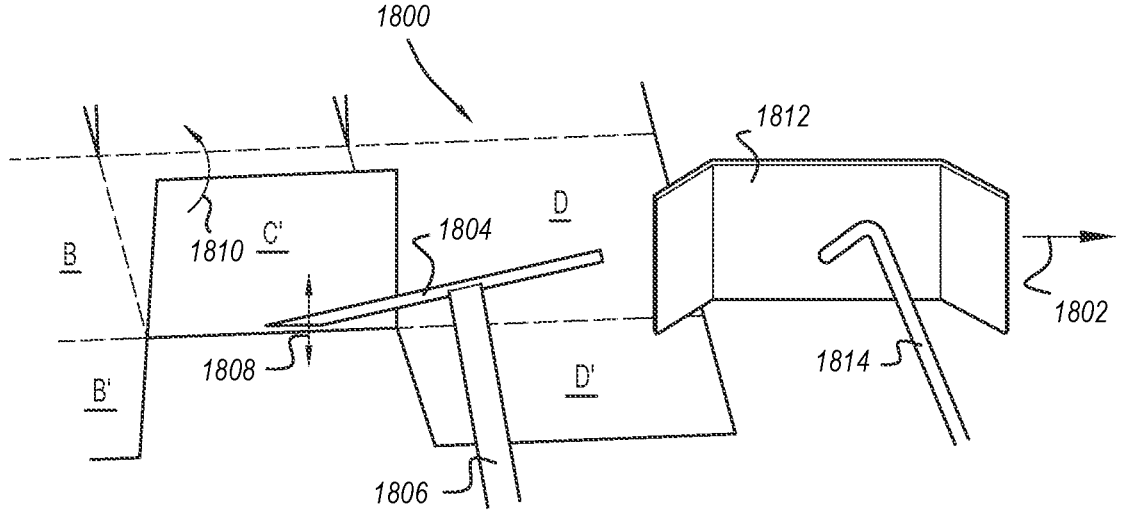
FIG. 19 illustrates a finger for folding upward the side flaps of a box blank.

FIG. 19 shows the folding upward of side panels of the blank 1800. This folding upward may take place during a forward movement in the direction of movement 1802 of blank 1800. The blank is for this purpose positioned on a feed line with its longitudinal direction in the feed direction. Provided on either side of the feed line are fingers 1804 which can be positioned relative to the blank via a finger arm 1806. By moving the blank in the direction of movement 1802, the four side panels D', C', B' and A' will pass finger 1804. Finger 1804 can be positioned relative to the side panels. More particularly, the distance between finger 1804 and a central axis of blank 1800 is adjustable, such that finger 1804 can be positioned relative to blank 1800 in the transverse direction. This allows finger 1804 to be positioned in the transverse direction, at the position of the side panels. More particularly, finger 1804 may be positioned overlapping with the side panels and in the vicinity of the central panels.

Finger 1804 may be oriented with a distal end which extends counter to the direction of movement 1802, and the distal end points at least slightly downward. Pointing slightly downward is defined as the finger forming, at least at the position of the distal end, an angle with the horizontal plane of a maximum of 30 degrees, preferably a maximum of 20 degrees, more preferably a maximum of 15 degrees.

Finger arm 1806 is further provided to control the height of finger 1804. This is shown in FIG. 9 with arrow 1808. The height of finger 1804 may be controlled such that the distal end is situated above a side flap D' when side flap D' arrives at the distal end of finger 1804 due to the forward movement in the direction of movement 1802. The finger can then be moved downward 1808 so as to lie with a distal end of the finger under side flap C' when side flap C' arrives at finger 1804. The result hereof is that the finger will engage under side flap C' and will fold side flap C' upward as illustrated with arrow 1810. The distal end of the finger can here press on side flap D', without this being a drawback. On the basis of this description, and in combination with FIG. 9, the skilled person will appreciate that forming and controlling of a finger 1804 relative to the flaps allows side flaps to be folded upward or to not be folded upward in an extremely simple manner. Because of the adjustability in the transverse direction, side flaps can even be folded upward or not folded upward irrespective of the width b of the box. This construction allows a device for folding boxes with different dimensions to be formed in simple manner. This construction also provides for a simple method.

A side flap holder 1812 is further provided which is mounted on a side flap holder arm 1814 for the purpose of holding the upward folded side flap in place during the forward movement of the blank over the feed line. The side flap holder 1812 is not shown in the further figures, but is deemed preferably present for holding the side flaps in the folded position during further folding steps.

The result of the folding upward of side flap C', and of side flap A', as will be further elucidated hereinbelow, is that the stiffness of segment C and segment A, for the benefit of the folding upward of these segments for the purpose of forming the upright walls of the box, increases considerably. Because side flaps C' and A' are folded upward, central panels C and A are also strengthened in that the flexibility of panels C and A decreases considerably at the position of the connection to side flap C' and A'. The skilled person will appreciate that the stiffness of sections C and A is high once side flaps C' and A' have been folded upward. This allows segments C and A to be folded upward in a less controlled, even rough manner, without this being detrimental to the reliability of the folding upward. After side flaps C' and A' have been folded upward, side flap B' can optionally also be folded at least partially upward. Folding side flap B' upward through for instance about 35 degrees prevents undesired unfolding of side flaps C' and A', i.e. this is prevented by the partially upward folded side flap B'.

The skilled person will appreciate that when plate-like material is handled for folding, it is easy for an undesired fold to be created when the plate-like material is not wholly supported to sufficient extent during the folding movement. Such situations are avoided by first folding side flaps C' and A' upward. It will be almost impossible for an undesired fold to be created in the A-segment and C-segment as long as side flaps A' and C' form an angle with the respective central panels A and C. This is particularly advantageous when boxes with different dimensions are folded in one device. This is because the box can be folded considerably more easily, and the method of folding is considerably more robust when segments A and C are allowed to be handled more roughly and/or in less controlled manner. This makes it possible to provide an arm or pressing element or folding element which does not necessarily support the whole panel A and/or C during folding upward of the respective panel.

Figure 20A:
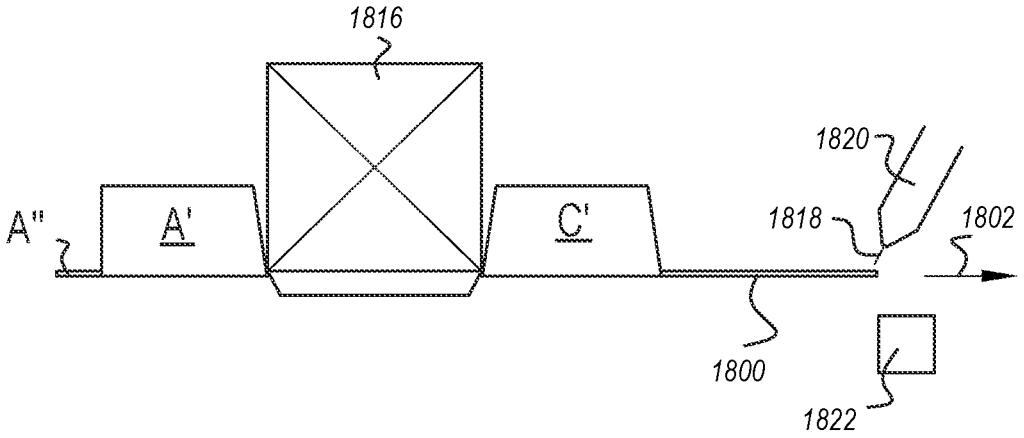
FIGS. 20A-20E illustrate an example sequence of folding steps for folding a box blank into a box.

FIG. 20A shows blank 1800. In the situation of FIG. 20A, a good or goods 1816 has/have already been placed on the panel B of blank 1800. Side flaps C' and A' have further already been folded upward. In the situation of FIG. 20A, the central panels A, B, C, D have not been folded upward yet, and still lie on the feed line (not shown in FIG. 20). The direction of movement is illustrated in FIG. 20A with arrow 1802. When blank 1800 moves in the direction of movement 1802, glue 1818 is applied at a front end of blank 1800, to panel D, via a glue gun 1820. FIG. 20A further shows that an arm 1822 extends under the feed line, and thus under blank 1800, in an initial phase of the method.

Figure 20B:
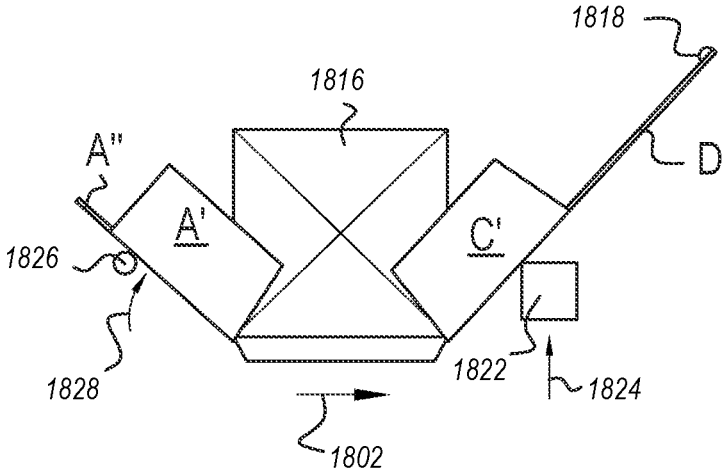

FIG. 20B shows a further step wherein arm 1822 moves upward from a position under the feed line. This upward movement of arm 1822 is illustrated with an arrow 1824. During the upward movement 1824 of arm 1822, blank 1800 can still be advanced in the direction of movement 1802. On the rear side, the rear wall is folded upward via an actuator 1824. Folding upward of the rear wall is illustrated with arrow 1828. Actuator 1826 can be embodied in different ways. Because side flaps A' and C' have already been folded upward, segments A and C of the blank are stiff and can be folded upward in a simple manner by arm 1822 and actuator 1826. Depending on the size of the blank, undesired folding of first segment D may occur as a result of the upward movement 1824 of arm 1822. As a result of the direction of movement 1802 and as a result of the force of gravity the fold will typically be directed forward (in clockwise direction in FIG. 20B), such that arm 1822 always comes to lie under segment D. Because of the upward movement of the arm, the arm will still be able to move the segment D upward, even when it has an undesired forward fold. The applied glue 1818 will not be able to bump against arm 1822 or against another part of blank 1800 due such an uncontrolled movement either.

The skilled person will appreciate that the exact order of the application of the glue, the folding upward of side flaps A' and C' and the placing of the goods on the blank can vary from one embodiment to another.

Figure 20C:
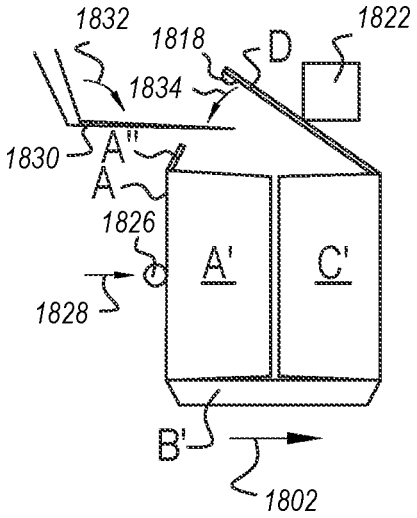

FIG. 20C shows a further phase of the folding. Rear panel A of blank 1800 has been folded completely upward so as to form the rear wall of the box. Actuator 1826 follows the advancing movement 1802 of the blank in order to keep rear wall A positioned correctly. When rear wall A is folded upward, a positioning finger 1830 is moved, from above, forward and downward, as illustrated with arrow 1832, up to the upper side of the box. With this forward and downward movement 1832, the positioning finger 1830 will fold closing flap A", which forms the overlap as described above, forward.

Positioning finger 1830 further has the function of catching the first segment D. First segment D is folded over the goods by arm 1822 so as to form the upper side of the box. As described above, upper segment D can have undesired folds, and the movement of the folding of this front segment D is not wholly controlled. Depending on the size of the box, the strength of the sheet material and the speed of the folding, the front segment D will drop downward as the upper wall of the box more quickly or more slowly, optionally considerably forced by arm 1822. This dropping down is illustrated with arrow 1834. The dropping down 1834 of first segment D is stopped by positioning finger 1830. When a false crease is present in first segment D, first segment D may drop down early and sharply. It will therefore be advantageous to have the positioning finger 1830 extend to a position substantially at the front of the box so as to enable first segment D to be caught correctly in all cases. The skilled person will appreciate that the shape of positioning finger 1830 is not crucial to application of the principles disclosed herein. The most important consideration in shaping the finger is the complementarity in the transverse direction with the applied glue. The fingers and the glue will preferably not overlap, as seen in the transverse direction. The skilled person will thus appreciate that it is also possible for two or more fingers to be formed, wherein glue is applied between the fingers, as seen in the transverse direction. This prevents glue 1818, which is situated on first segment D, from coming into undesired contact, contact at an incorrect location or premature contact with goods and/or with closing flap A". In order to prevent glue 1818 from coming into contact with positioning finger 1830, the positioning finger 1830 may take a narrow form, as seen in the transverse direction, and may be placed centrally relative to the box, while the glue is applied eccentrically, as seen in the width direction, and is thus not applied in the center.

Figure 20D:
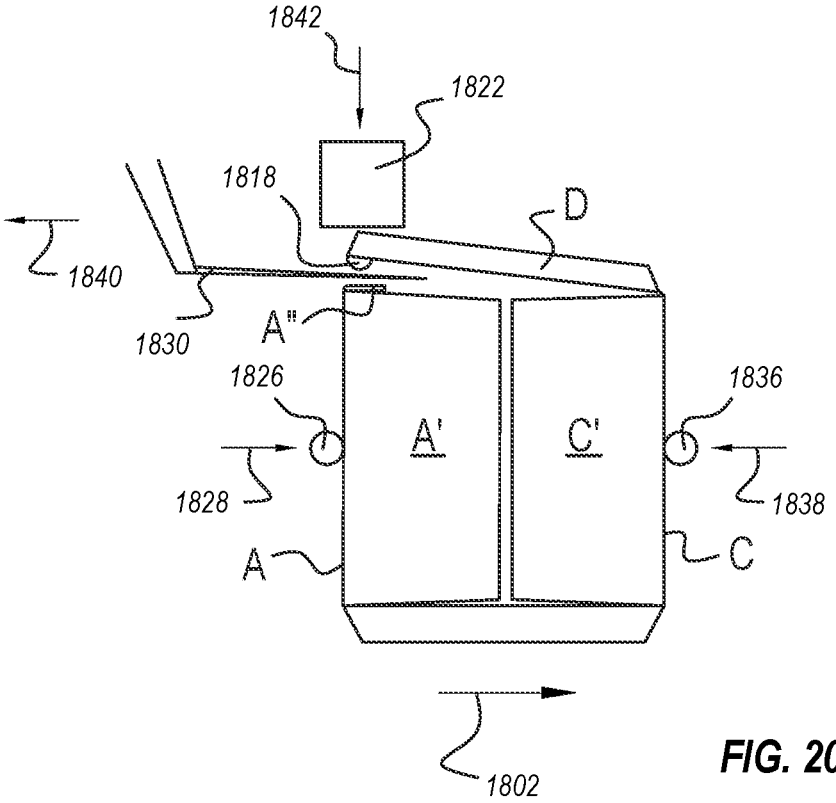

FIG. 20D shows a further phase in the method for the folding. In FIG. 20D, rear wall A has been folded upward and rear wall A is held in position by actuator 1826. At this point, front wall C has also been folded upward by the movement of arm 1822. Front wall C is preferably held in position by a further actuator 1836. The upward front wall, formed by the C-segment of the blank, can be held in position optimally by actuator 1836. This is illustrated with arrow 1838. Actuator 1836 may be provided at the position of an upper side of the box with a finger (not shown) which forms the angle between side panel and upper panel in order to make this a right angle. A similar finger can be provided on actuator 1826 so that actuators 1826 and 1836 are able to hold the box perpendicularly and at right angles. By positioning front wall C and real wall A, the upper wall D is also positioned correctly relative to closing flap A". This allows arm 1822 to press front segment D against closing flap A" so that glue 1818 comes to lie between the front and rear parts D and A of blank 1800. Positioning finger 1830 may be retracted here. Retracting can be done by actively moving positioning finger 1830 rearward, as illustrated with arrow 1840. Alternatively, and/or additionally, positioning finger 1830 can be retracted in a relative sense by an advancing movement in the direction of movement 1802 of the box. After the pressing 1842 has been carried out, the box is formed with an underside formed by the B-segment of the blank, a front wall formed by the C-segment of the blank, a rear wall formed by the A-segment of the blank and an upper wall formed by the D-segment of the blank. The side walls have already been partially formed by the upward folded side flaps A' and C'.

Figure 20E:
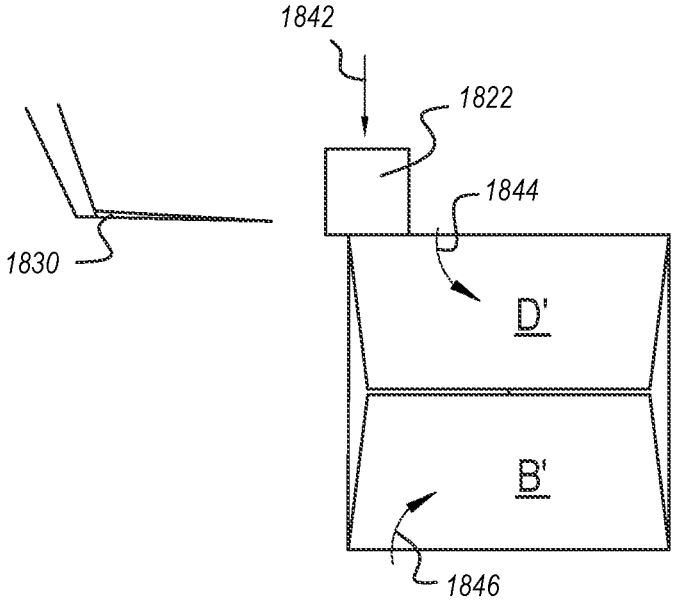

In FIG. 20E, the box is completed by folding downward 1844 of side flap D' and folding upward 1846 of side flap B'. Glue can be provided on one of the side flaps, so that side flap B' can be secured to side flap D'. Alternatively, side flaps B' and D' can be glued to the side flaps A' and C', which have already been folded upward. The skilled person will appreciate that the order of folding upward of side flap B' and folding downward of side flap D' can also be altered without having noticeable influence on the above described folding principles. FIG. 20E further illustrates how arm 1822 can finally press 1842 the upper side of the box D with closing flap A". FIG. 20E also shows that the positioning finger has been retracted.

Figure 21:
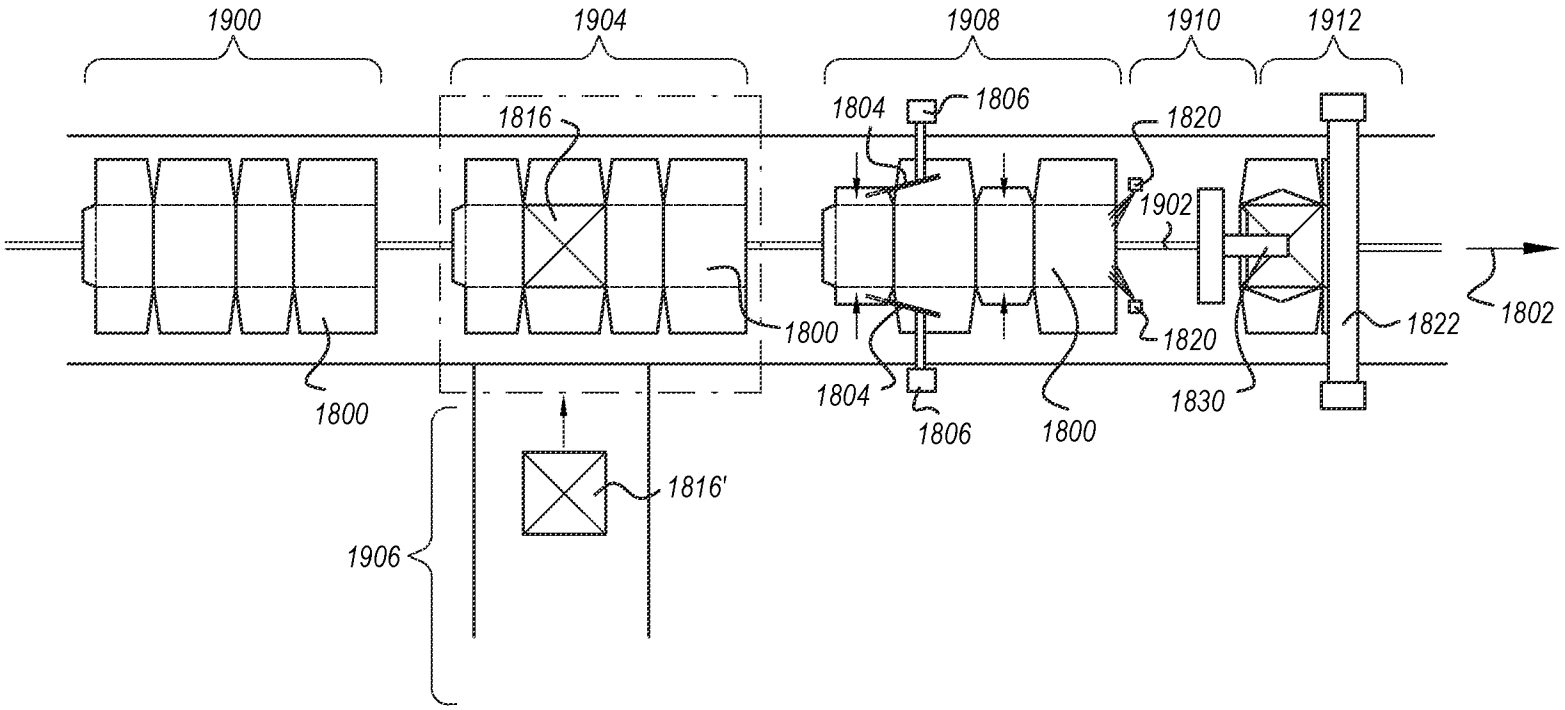
FIG. 21 illustrates a top view of an example device for folding a box according to one embodiment of the present disclosure.

FIG. 21 shows a top view of a device for folding boxes from blanks. The device is provided to package different goods with different dimensions in boxes made to a custom size. The device has for this purpose a supply section 1900 for supplying blanks 1800. The blanks are positioned on feed line 1902 at the position of the supply section, with the side panels transversely of feed line 1902. The feed line 1902 is provided to advance the blank in the direction of movement 1802. The device is further provided with a positioning section 1904. In the positioning section 1904, goods 1816 are positioned correctly on the blank 1800. In practice, a supply 1906 is provided for the goods. Supply 1906 may be linked operationally to supply section 1900 so that blanks 1800 which are supplied via supply section 1900 have a shape and dimensions corresponding to a shape and dimensions of the goods 1816, 1816' which are supplied via the supply. More particularly, successive goods 1816 and 1816' which are supplied have different dimensions, and corresponding blanks 1800 which are supplied via supply section 1900 have corresponding different dimensions.

At the position of positioning section 1904, the goods 1816 are positioned on a central panel B of blank 1800. The skilled person will appreciate on the basis of the above elucidation that the goods could also be positioned on the central panel C. In some operations, for instance, the moving of arm 1822 and positioning fingers 1804, would have to be performed differently therein. The movement of arm 1822 will become slightly more complex as a result of the direction of movement of the blank 1800, but the skilled person will appreciate that such a device can be constructed on the basis of the same operating principles. It is then possible to opt to have the closing flap A" connect onto an outer side of the box, or to move the closing flap to panel D.

When closing flap A" is formed at the position of panel D, the method can be performed as described above and as shown in the Figures. The closing flap D" will then overlap with panel A at the position of the upright side wall of the box. Arm 1822 can then further be provided to press the closing flap and the panel A against the side wall.

After goods 1816 have been positioned on blank 1800, blank 1800 is advanced by feed line 1902 to the first folding section 1908. At the position of first folding section 1908, the fingers 1804, which were elucidated above with reference to FIG. 19, provide for the upward folding of the side flaps which are positioned diagonally relative to the goods 1816. FIG. 21 shows how two fingers 1804 are provided on either side of the blank for the purpose of folding upward side flaps on either side of feed line 1902. The skilled person will appreciate that, depending on the width of the blank, this depending on the size of goods 1816, fingers 1804 may be moved closer to or further away from feed line 1902 by means of finger arms 1806.

In the embodiment of FIG. 21, the first folding section further comprises the glue guns 1820 for applying glue to the front segment of the blank 1800. It will be apparent that glue guns 1820 can also be provided at a different location on the feed line.

FIG. 21 further illustrates the second folding section 1910 and the third folding section 1912. In order to simply explain the operation of the device, the second folding section 1910 and the third folding section 1912 are illustrated as different parts of the device. In practice, these segments or sections 1910 and 1912 can be formed integrally or be mutually integrated. Furthermore, other sections 1900 and 1904 can also be formed integrally or be mutually integrated. At the position of the second folding section 1910, the rear wall is folded upward. The positioning finger 1830 will typically also be provided at the position of this folding section 1910. FIG. 21 illustrates that the positioning finger is narrow and that glue guns 1820 are provided in order to apply glue eccentrically, while positioning finger 1830 extends centrically.

Provided in the third folding section 1912 is the arm 1822 which, as elucidated above with reference to FIG. 20, moves from a position under feed line 1902 to a position above the box. Because of this movement and because of the forward movement in the direction of movement of the blank, the arm can perform the functions described above with reference to FIG. 20 in a simple manner. Positioning finger 1830 may be mounted on an actuator which allows positioning finger 1830 to be moved in the direction of movement 1802. Positioning finger 1830 may also be movable in the height. Arm 1822 can be provided from two parts which are provided on either side of the feed line. This allows the arm to move to a position under the feed line in simple manner without the arms colliding with feed line 1902.

The device can comprise yet another folding section (not shown) for folding upward and downward of side flaps B' and D'. Side flaps B' and D' can be provided here with glue in order to connect them to each other or to connect them to side flaps A' and/or C'. The device can also comprise yet another packing section, for instance, for securing a fixing one or more straps around the box. The device can further comprise a section for labelling of the box. Alternatively, the blanks can be supplied already labelled on the basis of the operational link between supply device 1900 and supply 1906.

One will appreciate that altering the order, number, and types of folding steps and processes described herein may allow a manufacturer and/or distributor to form any number of box shapes and sizes. These various box shapes and sizes may be altered, designed, and customized to accommodate any number of product shapes and sizes that are to be packaged within the box. Accordingly, box forming machines of the present disclosure are configured to form customized boxes that fit around products without wasted box material or added packaging materials. In addition, box forming machines of the present disclosure are configured to form such boxes without fanfold scores (or "false scores") negatively affecting the box forming steps and/or processes described herein. As such, the methods, processes, and apparatus described herein may successfully form customizable boxes from generic fanfold material having fanfold scores.

In light of the disclosure herein, embodiments may take a variety of forms or may include a variety of different combinations of the features described herein. By way of example, a method of forming a box from a blank can include:

providing a blank on a drive line, the blank comprising:
- a plurality of panels including a leading panel, an intermediate panel, a bottom panel, and a trailing panel; and
- a plurality of side panels extending transversely to the drive line, each panel connected to two opposing side panels;
- a glue tab with or without connected side panels; positioning one or more goods on the bottom panel;

moving the blank forward on the drive line;

folding the side panels up and down in an alternating fashion as the blank moves forward on the drive line so that the panels from which each folded side panel extends are rigidified; and holding the side panels that have been folded up in position as the blank moves forward on the drive line.

In some embodiments, the method also includes lifting the trailing panel upward to form a back surface of the box. In some embodiments, the method also includes holding the trailing panel at a first angle relative to the bottom panel to maintain a bottom trailing corner of the box as the blank moves forward on the drive line.

In some embodiments, the method also includes:

lifting the leading panel and the intermediate panel up and over the one or more goods to form a top surface and a front surface of the box, respectively, so that the leading panel makes contact with a glue tab extending from the trailing panel as the blank moves forward on the drive line; and holding the leading panel at a second angle relative to the intermediate panel to maintain a top leading corner of the box as the blank moves forward on the drive line.

In some embodiments, the method also includes holding the bottom panel down while the leading panel and intermediate panel are folded up over the one or more goods. Similarly, in some embodiments, the method also includes holding the bottom panel down while the trailing panel is lifted up to from the back surface of the box.

In some embodiments, a horizontally extending spatula folds the glue tab downward and a leading edge of the spatula engages a boundary between the leading panel and the intermediate panel so that the leading panel bends relative to the intermediate panel at the boundary when lifting the leading panel and intermediate panel up and over the one or more goods.

In some embodiments, the method also includes folding the side panels to form left and right surfaces of the box as the blank moves forward on the drive line. In some embodiments, the side panels that have been folded up are held in position with a holder. In some embodiments, a bottom leading corner of the holder is chamfered. In some embodiments, the leading panel and the intermediate panel begin to be lifted up and over the one or more goods before the intermediate panel has completely passed a leading edge of the holder as the blank moves forward on the drive line. In some embodiments, the holder is stationary as the blank moves forward on the drive line.

In some embodiments, the side panels are folded up and down in an alternating fashion by one or more fingers that move up and down as the blank moves forward on the drive line. In some embodiments, the side panels extending from the bottom panel are folded downward to rigidify the bottom panel.

In another embodiment, a method of forming a box from fanfold material includes:

forming a blank from fanfold material, the fanfold material including fanfold scores, the blank including at least one false score extending transversely across the blank;

moving a blank forward longitudinally down a drive line, the blank comprising:
- a plurality of panels including a leading panel, an intermediate panel, a bottom panel, and a trailing panel; and
- a plurality of side panels extending transversely to the drive line, each panel connected to two opposing side panels;
- a glue tab with or without connected side panels;

folding the side panels up and down in an alternating fashion as the blank moves forward on the drive line so that the panels from which each folded side panel extends are rigidified; and holding the side panels that have been folded up in position as the blank moves forward on the drive line.

In some embodiments, the method also includes folding the leading panel and the intermediate panel up and over the bottom panel to form a top and front surface of a box, respectively. In some embodiments, the method also includes folding the trailing panel up and maintaining the trailing panel at an angle relative to the bottom panel to form a trailing bottom corner of a box. In some embodiments, the method also includes pushing a glue tab extending from the trailing panel down with a spatula, wherein the spatula comprises a leading edge that contacts a boundary between the leading panel and the intermediate panel as the intermediate panel and leading panel are folded up and over the bottom panel to form a front and top surface of a box, respectively.

In some embodiments, the method also includes holding the side panels in position as the blank moves forward on the drive line after the side panels have been folded up and down in an alternating fashion. In some embodiments, the method also includes holding the bottom panel down as the leading panel, intermediate panel, and trailing panel are folded to form the top, front, and rear surfaces of a box, respectively.

In another embodiment, a box forming machine includes:

a drive line having a longitudinal direction and a drive mechanism that transports a blank forward longitudinally on the drive line;

one or more fingers disposed next to the drive line, the one or more fingers configured to move up and down to bend side panels of the blank up and down in an alternating fashion;

one or more holders positioned forward from the one or more fingers, the one or more holders positioned so that the side panels of the blank are held in position by the one or more holders as the blank moves forward on the drive line.

In some embodiments, the box forming machine also includes one or more trailing squaring arms disposed on the drive line. In some embodiments, the one or more trailing squaring arms have a downward position and a raised position, wherein the one or more trailing squaring arms in the raised position maintain an angle of a bottom trailing corner of a box made from the blank as the blank moves forward on the drive line.

In some embodiments, the box forming machine also includes one or more leading squaring arms disposed at least partially above the drive line. In some embodiments, the one or more leading squaring arms are configured to maintain an angle of a top leading corner of a box formed from the blank as the blank moves forward on the drive line.

In some embodiments, the box forming machine also includes a spatula having a leading edge facing forward in the longitudinal direction of the drive line. In some embodiments, at least a portion of the spatula comprises a surface that is parallel to the drive line. In some embodiments, at least a portion of the spatula is disposed above the drive line.

In some embodiments, the one or more fingers each comprise an elongate member tapering down toward a trailing end thereof. In some embodiments, the elongate member of each of the one or more fingers is disposed parallel to the drive line in the longitudinal direction of the drive line.

In another embodiment, a method is provided for folding a box from a blank. The method is performed on a feed line with an advancing direction of movement. The method includes:

supplying the blank on the feed line such that side panels of the blank extend transversely of the feed line;

positioning one or more goods on a middle panel of the blank;

advancing the blank with the one or more goods along the feed line;

folding upward side panels which lie diagonally of the middle panel;

folding upward a rear panel and holding this panel in place as rear wall of the box;

folding upward front panels by moving an arm upward, during forward movement of the blank, from a first position under the feed line to a second position above the box, such that the box advances under the upward moved arm in order to thus form a front wall and an upper wall of the box with the front panels.

In some embodiments, the folding upward of the side panels is performed during forward movement of the blank on the feed line, by positioning fingers under the side panels.

In some embodiments, the blank has at least four central panels extending successively in the direction of movement of the feed line, wherein the middle panel is formed by the third of the at least four central panels.

In some embodiments, the method also includes:

applying glue to a glue zone in at least one of two areas of the blank which overlap when the box is being formed, pressing of the blank at the position of the glue zone after the box has been at least partially formed.

In some embodiments, prior to the pressing, a positioning finger is placed between the areas, adjacently of the glue zone, in order to prevent premature contact between the areas, after which the areas are positioned relative to each other so as to thereby at least partially form the box, after which the positioning finger is removed from between the areas.

In some embodiments, the positioning finger extends above the box in the direction of movement, such that the upper wall of the box comes to lie on the positioning finger when the arm folds the front panels upward.

In some embodiments, the method also includes folding downward side panels which are connected to the upper wall and folding upward side panels which are connected to the lower wall, so that the latter stated side panels form the side walls of the box.

In another embodiment, a device is provided for folding a box from a blank. The device includes:

a feed line with an advancing direction of movement;

a supply section for supplying the blank on the feed line such that side panels of the blank extend transversely of the feed line;

a positioning section for positioning one or more goods on a middle panel of the blank;

a feed section for advancing the blank with the one or more goods along the feed line;

a first folding section for folding upward side panels which lie diagonally of the middle panel;

a second folding section for folding upward a rear panel and holding this panel in place as rear wall of the box; and a third folding section for folding upward front panels by moving an arm upward from a first position under the feed line to a second position above the box, such that the box comes to lie under the upward moved arm in order to thus form a front wall and an upper wall of the box with the front panels.

In some embodiments, the first folding section comprises fingers which are movable in the transverse direction relative to the feed line so as to adjust the distance between opposite fingers to a width of the blank, and wherein the fingers extend in a direction opposite to the direction of movement with a distal end which can be moved upward and downward in order to grip under said side panels which lie diagonally of the middle panel.

In some embodiments, the device also includes:

glue gun for applying glue to a glue zone in at least one of two areas of the blank which overlap when the box is being formed;

pressing element for pressing of the blank at the position of the glue zone after the box has been at least partially formed.

In some embodiments, the device includes a positioning finger situated above the feed line, which positioning finger is movable in the direction of movement so as to extend between the areas in order to prevent premature contact between the areas, after which the areas are positioned relative to each other so as to thereby at least partially form the box, after which the positioning finger is removable from between the areas.

In some embodiments, the pressing element is formed by the arm, which is further provided to move in the direction of movement during pressing of the blank at the position of the glue zone.

In some embodiments, the device further comprises a fourth folding section for folding downward side panels which are connected to the upper wall and folding upward side panels which are connected to the lower wall, so that the latter stated side panels form the side walls of the box.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A box forming machine, comprising:

a drive line having a longitudinal direction and a drive mechanism that transports a blank forward longitudinally on the drive line;

a finger disposed adjacent to the drive line, the finger being configured to move up and down, the downward movement of the finger being configured to cause the finger to engage a top surface of a first side panel of the blank and bend the first side panel in a downward direction, the finger being configured to extend underneath a second side panel of the blank, the upward movement of the finger being configured to cause the finger to engage a bottom surface of the second side panel and bend the second side panel in an upward direction;

one or more holders positioned downstream from the finger, the one or more holders being positioned so that the second side panel of the blank is held in the upwardly bent position by the one or more holders as the blank moves forward on the drive line.

2. The box forming machine of claim 1, further comprising one or more trailing squaring arms disposed on the drive line.

3. The box forming machine of claim 2, wherein the one or more trailing squaring arms have a lowered position and a raised position, wherein the one or more trailing squaring arms in the raised position maintain an angle of a bottom trailing corner of a box made from the blank as the blank moves forward on the drive line.

4. The box forming machine of claim 1, further comprising one or more leading squaring arms disposed at least partially above the drive line.

5. The box forming machine of claim 4, wherein the one or more leading squaring arms are configured to maintain an angle of a top leading corner of a box formed from the blank as the blank moves forward on the drive line.

6. The box forming machine of claim 1, further comprising a spatula having a leading edge facing forward in the longitudinal direction of the drive line, wherein at least a portion of the spatula is disposed above the drive line.

7. The box forming machine of claim 6, wherein at least a portion of the spatula comprises a surface that is parallel to the drive line.

8. The box forming machine of claim 1, wherein the finger comprises an elongate member tapering down toward a trailing end thereof.

9. The box forming machine of claim 8, wherein the elongate member of the finger is disposed parallel to the drive line in the longitudinal direction of the drive line.

10. A device for folding a box from a blank, comprising:

a feed line with an advancing direction of movement;

a supply section for supplying the blank on the feed line such that side panels of the blank extend transversely of the feed line;

a positioning section for positioning one or more goods on a middle panel of the blank;

a feed section for advancing the blank with the one or more goods along the feed line;

a first folding section for folding upward side panels which lie diagonally of the middle panel;

a second folding section for folding upward a rear panel and holding this panel in place as rear wall of the box; and a third folding section for folding upward front panels by moving an arm upward from a first position under the feed line to a second position above the box, such that the box comes to lie under the upward moved arm to thus form a front wall and an upper wall of the box with the front panels.

11. The device according to claim 10, wherein the first folding section comprises fingers which are movable in the transverse direction relative to the feed line so as to adjust the distance between opposite fingers to a width of the blank, and wherein the fingers extend in a direction opposite to the direction of movement with a distal end which can be moved upward and downward in order to grip under said side panels which lie diagonally of the middle panel.

12. The device according to claim 10, wherein the device further comprises:

a glue applicator for applying glue to a glue zone in at least one of two areas of the blank which overlap when the box is being formed; and a pressing element for pressing of the blank at the position of the glue zone after the box has been at least partially formed.

13. The device according to claim 12, wherein the device comprises a positioning finger situated above the feed line, which positioning finger is movable in the direction of movement so as to extend between the two areas of the blank in order to prevent premature contact between the two areas of the blank, after which the two areas of the blank are positioned relative to each other so as to thereby at least partially form the box, after which the positioning finger is removable from between the two areas of the blank.

14. The device according to claim 12, wherein the pressing element is formed by the arm, which is further provided to move in the direction of movement during pressing of the blank at the position of the glue zone.

15. The device according to claim 10, wherein the device further comprises a fourth folding section for folding downward side panels which are connected to the upper wall and folding upward side panels which are connected to the lower wall, so that the latter stated side panels form the side walls of the box.

16. A device for folding a box from a blank, comprising:

a positioning section for positioning one or more goods on a middle panel of the blank;

a first folding section for folding side panels of the blank, the first folding section comprising:

a finger configured to move up and down, the downward movement of the finger being configured to cause the finger to engage a top surface of a first side panel of the blank and bend the first side panel in a downward direction, the finger being configured to extend underneath a second side panel of the blank, the upward movement of the finger being configured to cause the finger to engage a bottom surface of the second side panel and bend the second side panel in an upward direction; and one or more holders positioned downstream from the finger, the one or more holders being positioned so that the second side panel of the blank is held in the upwardly bent position by the one or more holders;

a second folding section for folding upward a rear panel and holding the rear panel in place as a rear wall of the box; and a third folding section for folding upward front panels by moving an arm upward from a first position under the feed line to a second position above the box, such that the box comes to lie under the upwardly moved arm to thus form a front wall and an upper wall of the box with the front panels.

17. The device of claim 16, further comprising one or more trailing squaring arms configured to engage the rear wall of the box, the one or more trailing squaring arms having a lowered position and a raised position, the one or more trailing squaring arms in the raised position maintain an angle of a bottom trailing corner of the box made from the blank.

18. The device of claim 16, further comprising one or more leading squaring arms disposed at least partially above the box, the one or more leading squaring arms being configured to maintain an angle of a top leading corner of the box formed from the blank.

19. The device of claim 1, further comprising a spatula having a leading edge configured to be selectively extended under the upper wall of the box.

20. The device of claim 1, wherein the finger comprises an elongate member tapering down toward a trailing end thereof.

* * * * *